US009239543B2

(12) United States Patent
Nishida et al.

(10) Patent No.: US 9,239,543 B2
(45) Date of Patent: Jan. 19, 2016

(54) DEVELOPER SUPPLY CONTAINER AND IMAGE FORMING APPARATUS

(71) Applicant: CANON KABUSHIKI KAISHA, Tokyo (JP)

(72) Inventors: Shinichi Nishida, Kawasaki (JP); Satoru Nitobe, Tokyo (JP); Kazuaki Takahata, Kawasaki (JP); Junji Yasuda, Kawasaki (JP); Takeshi Fujino, Yokohama (JP); Takayuki Tanaka, Tokyo (JP); Masashige Tamura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/301,523

(22) Filed: Jun. 11, 2014

(65) Prior Publication Data

US 2014/0363210 A1 Dec. 11, 2014

(30) Foreign Application Priority Data

Jun. 11, 2013 (JP) ..... 2013-122650

(51) Int. Cl.
*G03G 15/08* (2006.01)

(52) U.S. Cl.
CPC ..... *G03G 15/0874* (2013.01); *G03G 15/0894* (2013.01); *G03G 2215/0682* (2013.01)

(58) Field of Classification Search
CPC ..... G03G 15/0855; G03G 15/0865; G03G 15/0874; G03G 15/0875; G03G 15/0894; G03G 2215/0682; G03G 15/0822; G03G 15/0868; G03G 15/0879
See application file for complete search history.

(56) References Cited

U.S. PATENT DOCUMENTS

2001/0017998 A1* 8/2001 Terazawa et al. ..... 399/262
2005/0041998 A1* 2/2005 Fujii et al. ..... 399/258

FOREIGN PATENT DOCUMENTS

JP S60-232578 A 11/1985

* cited by examiner

*Primary Examiner* — Roy Y Yi
(74) *Attorney, Agent, or Firm* — Fitzpatrick, Cella, Harper & Scinto

(57) ABSTRACT

A developer supply container for use with an image forming apparatus includes a shell having an air passage and a discharge nozzle, a developer storage pouch storing developer contained inside the shell, and a discharging nozzle for discharging the developer accommodated in the developer storage pouch to outside of the developer supply container. In addition, an air passage allows air to communicate between inside and outside of the shell, and a seal attached to the shell seals the air passage to maintain a pressure inside the shell in a negative pressure state which is lower than a pressure outside the shell. The developer storage pouch is deformed to discharge the developer by peeling the seal off the shell to permit air to enter the shell through the air passage.

20 Claims, 11 Drawing Sheets

(a)

(b)

(a)

(b)

| MODES | VALVE 82 | VALVE 93 | PUMP 73 |
|---|---|---|---|
| MODE 1 | close | close | off |
| MODE 2 | close | close→open | off→on |
| MODE 3 | close | open→close | on→off |
| MODE 4 | close→open | close | off |
| MODE 5 | open | close→open | off |

(a)

(b)

| MODES | VALVE 82 | VALVE 93 | PUMP 73 |
|---|---|---|---|
| MODE 1 | close | close | off |
| MODE 2 | close | close | off→on |
| MODE 3 | close | close | on→off |
| MODE 4 | close→open | close | off |
| MODE 5 | open | close→open | off |

(a)

(b)

| MODES | VALVE 82 | VALVE 93 | PUMP 73 |
|---|---|---|---|
| MODE 1 | close | close | off |
| MODE 2 | close→open | close | off→on |
| MODE 3 | open | close | on→off |
| MODE 4 | open | close→open | off |

DEVELOPER SUPPLY CONTAINER AND IMAGE FORMING APPARATUS

FIELD OF THE INVENTION AND RELATED ART

The present invention relates to an image forming apparatus, such as a laser beam printer, an LED printer, a copying machine, etc., which employs a developer supply container, which is removably installable in an image forming apparatus, to supply the image forming apparatus with developer.

An electrophotographic image forming apparatus such as an electrophotographic printer uses developer made up of microscopic particles. Developer is consumed for image formation. Thus, as an electrophotographic image forming apparatus runs out of developer, it has to be replenished with developer with the use of a developer supply container.

It has been widely known that a developer supply container is equipped with such a member as a screw which is for conveying the developer in the container while stirring the developer.

In recent years, however, it has come to be desired to simplify a developing device in structure to reduce a developing device in cost, and/or make a developer supply container recyclable.

There is disclosed in Japanese Laid-open Patent Application S60-232578, for example, a developer supply container which is substantially smaller in component count than any conventional developer supply container. According to this patent application, the developer storing portion of the developer supply container is formed of an elastic substance, being enabled to expand or contract so that the developer in the main section can be discharged with the utilization of the resiliency of the elastic substance. Structuring a developer supply container like the one disclosed in the above-mentioned patent application makes it unnecessary to equip a developer supply container with a screw or the like member for conveying developer while stirring the developer. Therefore, it can reduce a developer supply container in component count.

By the way, a developer supply container for an image forming apparatus is required to stir the developer therein, and discharge the developer as necessary to supply or replenish the image forming apparatus with developer. In the case of the image forming apparatus disclosed in the above-mentioned patent application, its developer passage, through which the developer is discharged, is provided with a valve in order to control the discharging of the developer in the developer supply container by the resiliency of the elastic substance of which the developer supply container is made. Thus, the developer in the developer supply container can be discharged as necessary from the developer supply container while being stirred.

In the case of the developer supply container disclosed in Japanese Laid-open Patent Application S60-232578, the above-mentioned valve always remains under the pressure generated by the resiliency of the elastic substance in the direction to cause the developer supply container to discharge the developer therein. Therefore, the moment the valve begins to be opened, the pressurized air in the developer supply container begins to be released, and therefore, the developer begins to be discharged from the developer supply container by the released pressurized air. This creates a problem. That is, the developer begins to be discharged from the developer supply container before the valve is fully opened. Thus, the portion of the valve, which is still in the developer passage, increases the developer passage in the developer flow resistance preventing thereby the developer from being properly discharged from the developer supply container.

As the developer flow is partially blocked by the portion of the developer discharge passage, which is higher in developer flow resistance, it occurs sometimes that the toner particles in the block portion of the developer flow developer agglomerates into larger particles, which reduce the developing device (image forming apparatus) in image quality.

Further, in the case of a developer supply container structured to utilize temporary force, such as the resiliency of the elastic substance of which the developer storing portion of the developer supply container is made to discharge the developer in the developer storing portion, if the positive pressure in the developer storing portion is lost before the valve is fully opened, the pressure difference between the internal air pressure of the developer storing portion and the atmospheric pressure is sometimes lost before the developer in the developer storing portion is fully discharged. Therefore, the amount by which the developer in the developer supply container fails to be discharged is affected by the speed with which the valve is opened. Thus, it sometimes occurred that a substantial amount of developer in the developer supply container fails to be discharged from the container.

SUMMARY OF THE INVENTION

The present invention is made in consideration of the above-described issues. Thus, the primary object of the present invention is to provide a developer supply container which is significantly less in the amount of developer flow resistance to which the developer in the developer supply container is subjected as the developer is discharged from the developer supply container, and also, to provide an image forming apparatus which is compatible with such a developer supply container.

According to an aspect of the present invention, there is provided a developer supply container for use with an image forming apparatus, comprising a container shell; a developer accommodation bag accommodating a developer, said developer accommodation bag being contained in said container shell; a developer discharging path for discharging the developer accommodated in said developer accommodation bag to an outside of said developer supply container; an air fluid communication path for fluid communication between inside and outside of said container shell; and a maintaining portion sealing said air fluid communication path to maintain a pressure inside said container shell in a negative pressure state which is lower than a pressure outside said container shell, wherein said developer accommodation bag deforms to discharge the developer, by said maintaining portion opening said air fluid communication path to permit air to enter said container shell through said air fluid communication path.

Further features of the present invention will become apparent from the following description of exemplary embodiments (with reference to the attached drawings).

DESCRIPTION OF THE PREFERRED EMBODIMENTS

Hereinafter, some of the embodiments of the present invention are described in detail with reference with appended drawings.

In the following description of the embodiments of the present invention, the terms such as "upward, downward, vertical and horizontal" indicate the directions when an image forming apparatus is in normal usage, that is, when a development unit or a process cartridge has been properly installed in an image forming apparatus, and is ready for image formation.

Embodiment 1

(General Structure of Image Forming Apparatus)

Figure 1:
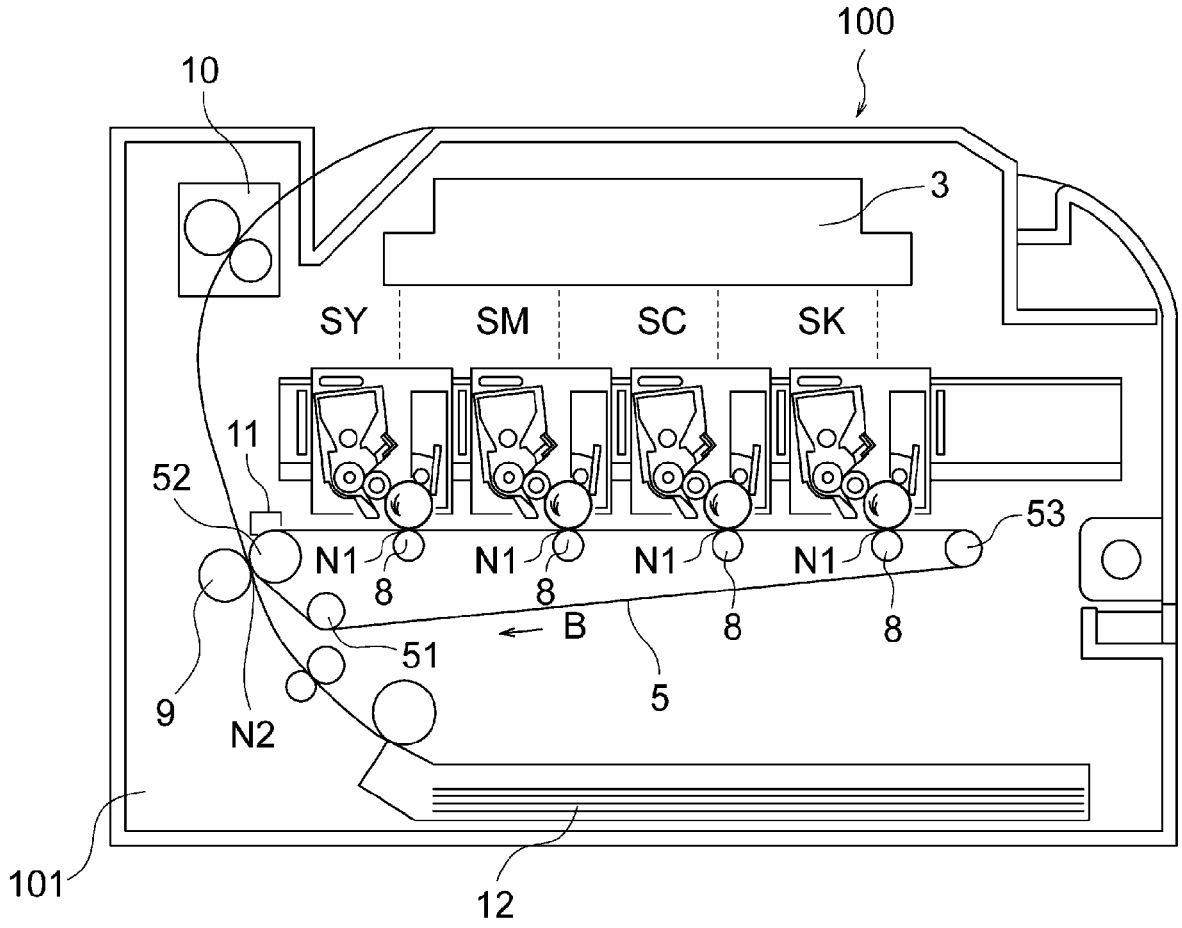
FIG. 1 is a schematic sectional view of a typical image forming apparatus to which the present invention is applicable.
Figure 2:
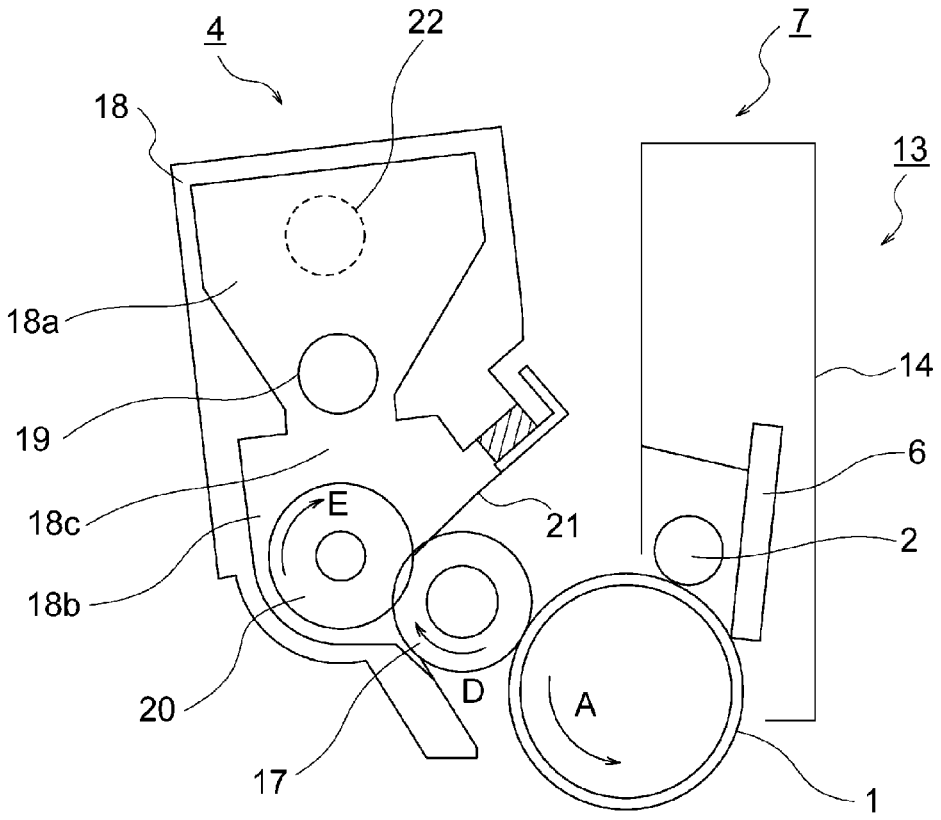
FIG. 2 is a schematic sectional view of a typical process cartridge which is removably installable in an image forming apparatus in accordance with the present invention, and is for describing the structure of the cartridge.

To begin with, referring to FIGS. 1 and 2, the image forming apparatus in this embodiment is described.

FIG. 1 is a schematic sectional view of the image forming apparatus in this embodiment. FIG. 2 is a process cartridge, which is installable in the image forming apparatus shown in FIG. 1. It shows the general structure of the process cartridge.

The image forming apparatus 100 is a full-color laser printer of the so-called inline type, and also, of the so-called intermediary transfer type. The image forming apparatus 100 forms a full-color image on a sheet 12 of recording medium such as ordinary paper, plastic, fabric, etc., according to the information of an image to be formed.

The information about an image to be formed is inputted into the main assembly 101 of the image forming apparatus 100 from an image reading apparatus which is in connection to the main assembly 101, or a host device such as a personal computer which is in connection to the main assembly 101 so that electrical signals can be exchanged between the host device and the main assembly 101.

The image forming apparatus 100 has multiple image forming portions, more specifically, image forming portions SY, SM, SC and SK for forming yellow (Y), magenta (M), cyan (C) and black (K) images, respectively. In this embodiment, the image forming portions SY, SM, SC and SK are horizontally aligned in parallel (tandem).

The image forming portions SY, SM, SC and SK are practically the same in structure and operation, although they are different in the color of the images they form. Thus, in the following description of the image forming apparatus, the suffixes Y, M, S and K which are for indicating color are not shown. That is, in terms of structural components, the four image forming portions are described together, unless they need to be differentiated.

The image forming apparatus 100 has multiple image bearing members, more specifically, four photosensitive drums 1 which are aligned in parallel (tandem) in the direction perpendicular to the vertical direction. Each photosensitive drum 1 is rotationally driven by an unshown driving means in the direction indicated by an arrow mark A in FIG. 2. The image forming apparatus 100 has also a charge roller 2 and a scanner unit 3, which are in the adjacencies of the peripheral surface of the photosensitive drum 1. The charge roller 2 is for uniformly charging the peripheral surface of the photosensitive drum 1. The scanner unit 3 is an exposing means. It forms an electrostatic latent image on the peripheral surface of the photosensitive drum 1, by emitting a beam of laser light while modulating the beam of laser light according to the information of the image to be formed.

The image forming apparatus 100 has also development unit 4 and a cleaning member 6, which also are disposed in the adjacencies of the peripheral surface of the photosensitive drum 1. The development unit 4 is a developing means for developing the electrostatic image into a toner image. The cleaning member 6 is for removing the transfer residual toner, that is, the toner remaining on the peripheral surface of the photosensitive drum 1 after the transfer of a toner image from the photosensitive drum 1. Further, the image forming apparatus 100 has an intermediary transfer belt 5, as an intermediary transferring member, which is for transferring the toner image on the photosensitive drum 1, onto the sheet 12 of recording medium. The intermediary transfer belt 5 is positioned so that it directly faces the four photosensitive drums 1. In terms of the rotational direction of the photosensitive drum 1, the point at which the peripheral surface of the photosensitive drum 1 is charged by the charge roller 2, is the point at which the peripheral surface of the photosensitive drum 1 is exposed, the point at which the electrostatic latent image on the peripheral surface of the photosensitive drum 1 is developed, the point at which the toner image is transferred onto the intermediary transfer belt 5, and the point at which the peripheral surface of the photosensitive drum 1 is cleaned by the cleaning member 6, are positioned in the listed order.

The development unit 4 reversely develops the electrostatic latent image on the peripheral surface of the photosensitive drum 1, by placing the development roller 17, as a developer bearing member, in contact with the photosensitive drum 1. That is, the development unit 4 develops the electrostatic image, by adhering toner charged to the same polarity (negative in this embodiment) as the photosensitive drum 1, to the various points of the peripheral surface of the photosensitive drum 1, which have just been made to attenuate in the amount of charge, by the exposure.

The intermediary transfer belt 5 is an endless belt. It is placed in contact with the peripheral surface of the photosensitive drum 1, and circularly moves in the direction indicated by an arrow mark B in FIG. 1. It is suspended, and kept tensioned, by multiple belt supporting members, more specifically, an idler roller 51, a belt backing roller 52 (which opposes primary transfer roller), and a driver roller 53.

On the inward side of the loop (belt loop) which the intermediary transfer belt 5 forms, four primary transfer rollers 8 are disposed in parallel in such a manner that they oppose the photosensitive drums 1 one for one. Each primary transfer roller 8 forms a primary transfer portion N1, which is the area of contact between the intermediary transfer belt 5 and photosensitive drum 1, by pressing the intermediary transfer belt 5 upon the peripheral surface of the photosensitive drum 1. To the primary transfer roller 8, bias which is opposite in polarity from the normal toner polarity is applied from a first transfer bias power source (unshown). Thus, the toner image on the photosensitive drum 1 is transferred (primary transfer) onto the intermediary transfer belt 5.

On the outward side of the loop which the intermediary transfer belt 5 forms, there is a secondary transfer roller 9, which is positioned so that it opposes the belt backing roller 52. The secondary transfer roller 9 forms a secondary transfer portion N2, that is, the area of contact between itself and intermediary transfer belt 5, by being pressed against the belt backing roller 52, with the presence of the intermediary transfer belt 5 between itself and belt backing roller 52. To the secondary transfer roller 9, bias which is opposite in polarity from the normal toner polarity is applied from an unshown secondary transfer bias power source. Thus, the toner image on the intermediary transfer belt 5 is transferred (secondary transfer) onto the sheet 12 of recording medium.

(General Operation of Image Forming Apparatus)

When an image is formed by the image forming apparatus 100 in this embodiment, first, the peripheral surface of the photosensitive drum 1 is uniformly charged by the charge roller 2. Then, the uniformly charged portion of the peripheral surface of the photosensitive drum 1 is scanned by (exposed to) the beam of laser light projected by the scanner unit 3 while being modulated according to the information of the image to be formed. Consequently, an electrostatic latent image which is in accordance with the information is effected on the peripheral surface of the photosensitive drum 1. This electrostatic latent image on the peripheral surface of the photosensitive drum 1 is developed into a toner image, by the development unit 4.

Then, the toner image on the photosensitive drum 1 is transferred (primary transfer) onto the intermediary transfer belt 5 by the function of the primary transfer roller 8. During the formation of a full-color image, the above-described process is carried out in the listed sequence in the image forming portions SY, SM, SC and SK. As a result, four monochromatic toner images, different in color, are transferred (primary transfer) in layers onto the intermediary transfer belt 5.

Meanwhile, the sheet 12 of recording medium is conveyed to the secondary transfer portion N2 in synchronism with the circular movement of the intermediary transfer belt 5, and is conveyed through the secondary transfer portion N2. While the sheet 12 of recording medium is conveyed through the secondary transfer portion N2, the four monochromatic toner images, different in color, on the intermediary transfer belt 5 are transferred together (secondary transfer) onto the sheet 12 of recording medium by the function of the secondary transfer roller 9.

After the toner image transfer onto the sheet P of recording medium, the sheet 12 is conveyed to a fixing device 10, in which the sheet 12 and the toner images thereon are subjected to heat and pressure. Thus, the toner images become fixed to the sheet 12.

The primary transfer toner, that is, the toner remaining on the peripheral surface of the photosensitive drum 1 after the primary transfer, is removed and recovered by the cleaning member 6. As for the secondary transfer residual toner, that is, the toner remaining on the intermediary transfer belt 5 after the secondary transfer, is removed by an intermediary transfer belt cleaning device 11; the intermediary transfer belt 5 is cleaned by the device 11.

(Structure of Process Cartridge)

Next, the process cartridge which is removably installable in the image forming apparatus 100 is described about its structure.

Referring to FIG. 2, the photosensitive drum 1, charge roller 2, development unit 4, and cleaning member 6 make up a process cartridge 7 by being integrally placed in a cartridge. The process cartridge 7 is removably installable in the main assembly 101 of the image forming apparatus 100, by being guided by such means as a cartridge installation guide, a cartridge positioning member, etc., of the main assembly 101 of the image forming apparatus 100. In this embodiment, the four process cartridges 7 which correspond to four primary colors, one for one, of which the multicolor image to be formed is made up, are the same in structure. The four process cartridges 7 contain yellow (Y), magenta (M), cyan (C) and black (K) toners, one for one.

The process cartridge 7 is an integral combination of a photosensitive member unit 13 having the photosensitive drum 1, and the development unit 4 having the development roller 17, etc.

The photosensitive drum unit 13 has a cleaning means frame 14 as a frame for supporting various components of the photosensitive drum unit 13. That is, the cleaning means frame 14 supports the charge roller 2, cleaning member 6, etc., in addition to the photosensitive drum 1.

As for the development unit 4, it has a developing means frame as a frame for supporting various components of the development unit 4. The development unit 4 has the development roller 17 which rotates in the direction indicated by an arrow mark in FIG. 2, in contact with the photosensitive drum 1.

The development unit 4 has also a toner supply roller 20, which rotates in the direction indicated by an arrow mark E in FIG. 2, virtually in contact with the peripheral surface of the development roller 17 to supply the development roller 17 with toner.

The developing means frame 18 has a development blade 21 for regulating in thickness the toner layer on the peripheral surface of the development roller 17. The development blade 21 is a piece of springy metallic plate. It is kept pressed upon the peripheral surface of the development roller 17 so that a preset amount of contact pressure is maintained between the development blade 21 and development roller 17. Thus, a thin layer of toner is formed on the peripheral surface of the development roller 17, and is supplied to the peripheral surface of the photosensitive drum 1.

Further, the developing means frame 18 has a toner storage chamber 18*a* for temporarily storing toner, and a development chamber 18*b* in which the development roller 17, toner supply roller 29, etc., are held. The toner storage chamber 18*a* is provided with a toner entrance 22, through which the toner storage chamber 18*a* receives toner.

The toner storage chamber 18*a* and development chamber 18*b* are in connection to each other through an opening 18*c* as a toner passage. Thus, the toner with which the toner storage chamber 18*a* is supplied is conveyed to the development chamber 18*b* by a stirring member 19 with which the toner storage chamber 18*a* is provided.

In the development unit 4 structured as described above, as toner enters the toner storage chamber 18*a* through the toner entrance 22, it is temporarily stored in the toner storage chamber 18*a*. However, the development unit 4 may be structured so that toner directly enters the development chamber 18*b* through the toner entrance 22.

(Structure of Toner Cartridge)

Next, the toner cartridge (developer supply container) which supplies the development unit 4 with toner is described.

Figure 3:
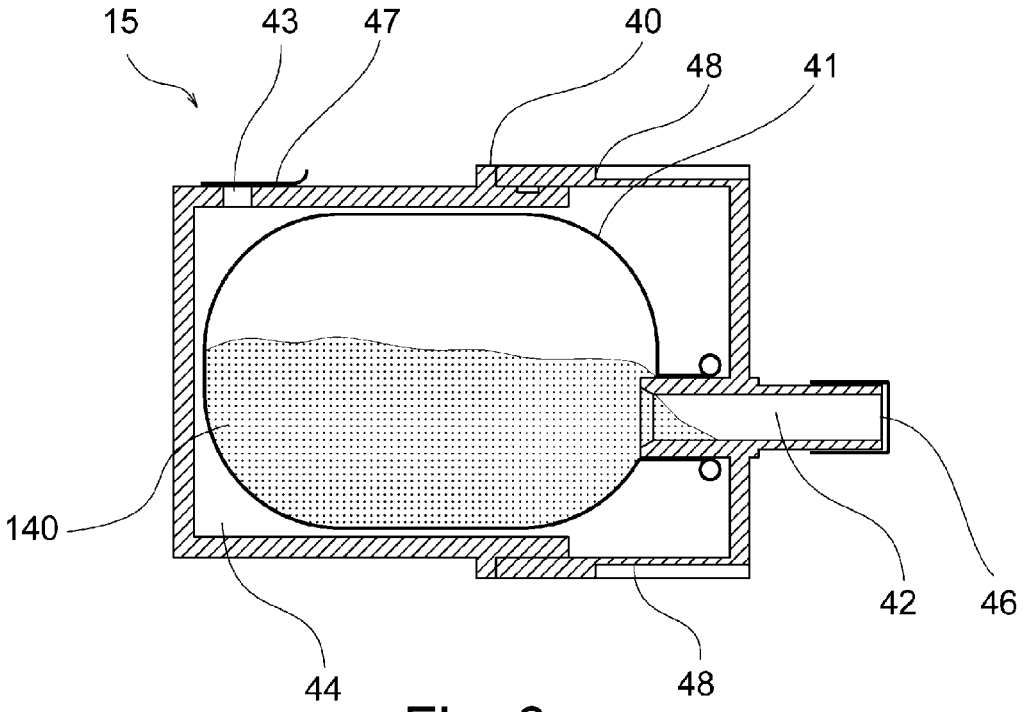
FIG. 3 is a schematic sectional view of a typical toner cartridge which is removably installable in an image forming apparatus in accordance with the present invention.
Figure 4:
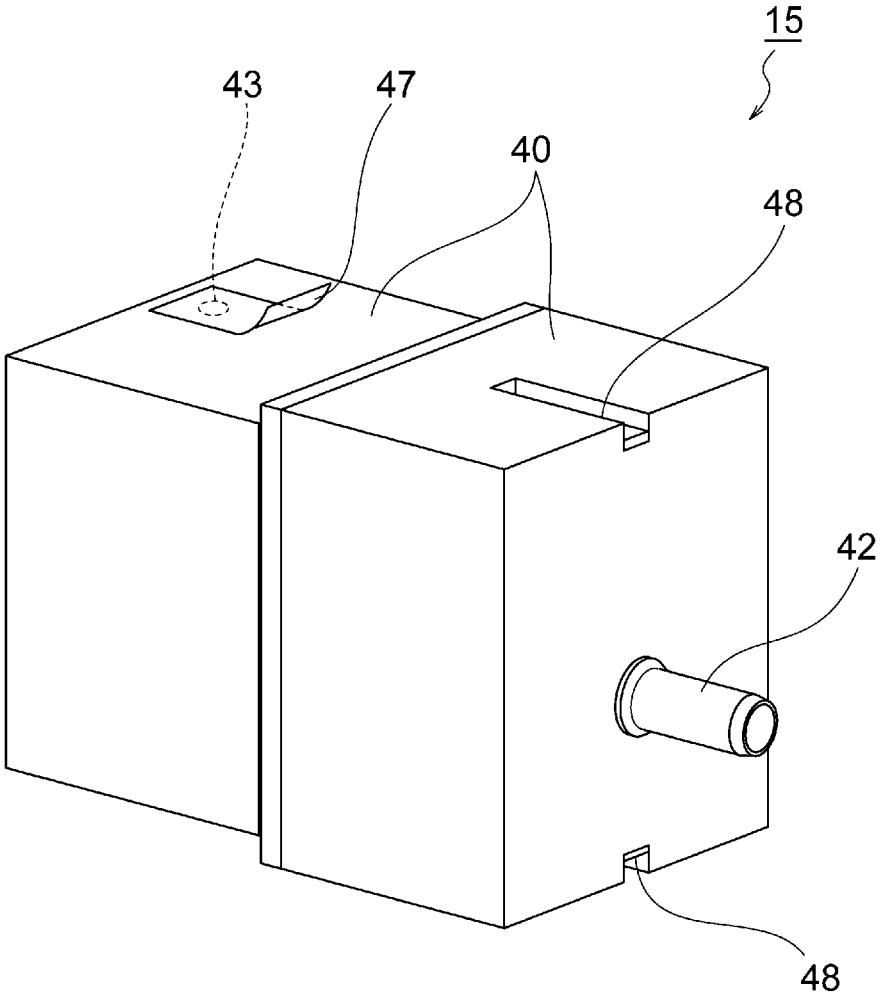
FIG. 4 is a schematic external perspective view of the toner cartridge in the first embodiment of the present invention.

FIG. 3 is a sectional view of the toner cartridge, and FIG. 4 is an external perspective view of the toner cartridge.

The toner cartridge 15 has a toner storage pouch 41 (developer storage pouch), which has elasticity (resiliency) and is expandable (inflatable) to store toner 140. It has also an external shell 40 which internally holds the toner storage pouch 41. The external shell 40 functions as a frame for supporting the internal components of the toner cartridge 15 other than the toner storage pouch 41, in addition to the toner storage pouch 40.

The external shell 40 is provided with a toner discharge nozzle 42 (developer discharge passage), an air passage 43, and a cartridge installation guide 48. The toner discharge nozzle 42 is in connection to the toner storage pouch 41, in the external shell 40. Thus, it is through the toner discharge nozzle that the toner 140 in the toner storage pouch 41 is discharged from the external shell 40. The toner storage pouch 41 is supported by the external shell 40 by being in connection to the toner discharge nozzle 42.

The toner discharge nozzle 42 is a cylindrical tube, and protrudes from the external shell 40 in such a direction that its axial line is parallel to the direction in which the toner cartridge 15 is installed into the apparatus main assembly 101.

The air passage 43 connects an airtight chamber 44, which is the space between the external shell 40 and toner storage pouch 41, with the ambient air (atmospheric air). It allows air to move between the airtight chamber 44 and the outside of the external shell 40.

As for the material for the external shell 40, it is desired to be such a substance that can provide the external shell 40 with such an amount of rigidity that can prevent the external shell 40 from being severely deformed by the change in the internal pressure of the external shell 40. In this embodiment, polystyrene is used as the material for the external shell 40. Also regarding the material for the external shell 40, it may be practically any substance as long as it can enable the external shell 40 to withstand a certain amount of pressure. For example, it may be ABS, polyester, polyethylene, polypropylene, or the like resin. It may be also a metallic substance.

As the material for the toner storage pouch 41, various resins can be used. For example, polyamide, polyurethane, polyamide elastomer, polyester elastomer, polyurethane elastomer, polystyrene elastomer, fluorinated elastomer, silicone rubber, latex rubber, or the like elastomer, may be used. Further, the material for the toner storage pouch 41 may be a combination of two or more among the above listed substances. In particular, from the standpoint of providing the toner storage pouch 41 with a large amount of internal pressure for discharging the toner, it is desired that a substance which is substantially stretchable and great in resiliency is used as the material for the toner storage pouch 41. In this embodiment, among the above listed substances, latex rubber was used as a preferable material for the toner storage pouch 41, from the standpoint of stretchability and flexibility.

In consideration of the amount of resistance which the toner discharge nozzle 42 generates against the toner flow as the toner 140 is discharged through the toner discharge passage 14, the internal diameter of the toner discharge passage 41 is desired to be no less than 4 mm. In comparison, the air passage 43 is a passage through which only air moves into, or out of, the airtight chamber 44. Therefore, the amount of resistance which the air passage 43 generates when air moves through the air passage 43 is does not matter. Therefore, the air passage 43 may be smaller in internal diameter than the toner discharge nozzle 42. However, the internal diameter of the air passage 43 is desired to be no less than 2 mm.

Concretely, in this embodiment, the toner discharge nozzle 42 and air passage 43 are 6 mm and 4 mm, respectively, in internal diameter. Setting the internal diameter of the air passage 43 to be smaller than that of the toner discharge nozzle 42 makes it possible to reduce the toner cartridge 15 and image forming apparatus 100 in size.

According to the gist of the present invention, this embodiment is not intended to limit the present invention in scope in terms of the specification, in particular, dimension, of the toner cartridge 15.

(Filling of Toner Cartridge with Toner)

Next, the procedure for filling the toner cartridge 15 with toner 140 is described.

The toner storage pouch 41 for storing toner 140 is filled with a preset amount of toner 140, and also, a certain amount of air. The toner storage pouch 41 is elastic. Thus, as air is injected into the toner storage pouch 41, the toner storage pouch 41 expands (inflates) in the external shell 40, causing thereby the air in the airtight chamber 44 to discharge out of the external shell 40 through the air passage 43.

After the filling of the toner storage pouch 41 with the preset amount of toner 140, and the certain amount of air, the air passage 43 is airtightly sealed with a thin film seal 47 (means for keeping airtight chamber negative in internal pressure) for preventing air from entering into, or exiting from, the airtight chamber 44 through the air passage 43. Thus, unless the thin film seal 47 is removed, it does not occur that the atmospheric air flows into the airtight chamber 44, or the air in the airtight chamber 44 flows out of the external shell 40 (airtight chamber 44).

In other words, it is after the air in the airtight chamber 44 is pushed out of the external shell 40 by the expansion (inflation) of the toner storage pouch 41 that the air passage 4 is blocked by the thin film seal 47 to prevent the atmospheric air from flowing into the interior (airtight chamber 44) of the external shell 40.

On the other hand, the toner storage pouch 41 tends to contract (deflate) because of its resiliency provided by the elasticity of the substance of which it is made. However, the ambient air is prevented by the thin film seal 47 from flowing into the airtight chamber 44. Therefore, as the toner storage pouch 41 begins contract (deflate), the air in the airtight chamber 44 begins to be reduced in internal pressure. Thus, the air in the airtight chamber 44 begins to become low in pressure than the ambient air pressure (it becomes negative in pressure relative to atmospheric pressure). Consequently, the toner storage pouch 41 is made to remain expanded (inflated) in the external shell 40, with the amount of the force which causes the toner storage pouch 41 filled with the ambient air, to contract, being equal to the amount of the force generated by the negative air pressure in the airtight chamber 44. That is, the thin film seal 47 keeps the interior (airtight chamber 44) negative in pressure.

Therefore, even when the interior of the toner storage pouch 41 is open to the atmospheric air through the toner discharge nozzle 42, it is possible to prevent the toner 140 and air in the toner storage pouch 41 from being discharged out of the toner storage pouch 41 by the resiliency of the toner storage pouch 41.

Further, the toner discharge nozzle 42 is sealed with a seal 46 for the toner discharge nozzle 42, during the manufacturing of the toner cartridge 15, in order to prevent the toner 140 and air in the toner storage pouch 41 from being discharged while the toner cartridge 15 is shipped.

After the toner storage pouch 41 in which a preset amount of toner 140, and a certain amount of air, was present, was expended (inflated) in the external shell 40, which is 250 cc in capacity, to a size of 200 cc, the air pressure in the airtight chamber 44 was roughly −10 kPa relative to the atmospheric pressure. That is, the airtight chamber 44 remained negative in air pressure relative to the atmospheric air.

(Installation of Toner Cartridge)

Next, the procedure for installing the toner cartridge 15 into the image forming apparatus 100, and the procedure for discharging the toner 140 in the toner storage pouch 41, into the toner storage chamber 18*a* (supplying toner storage chamber with toner), are described.

Figure 5:
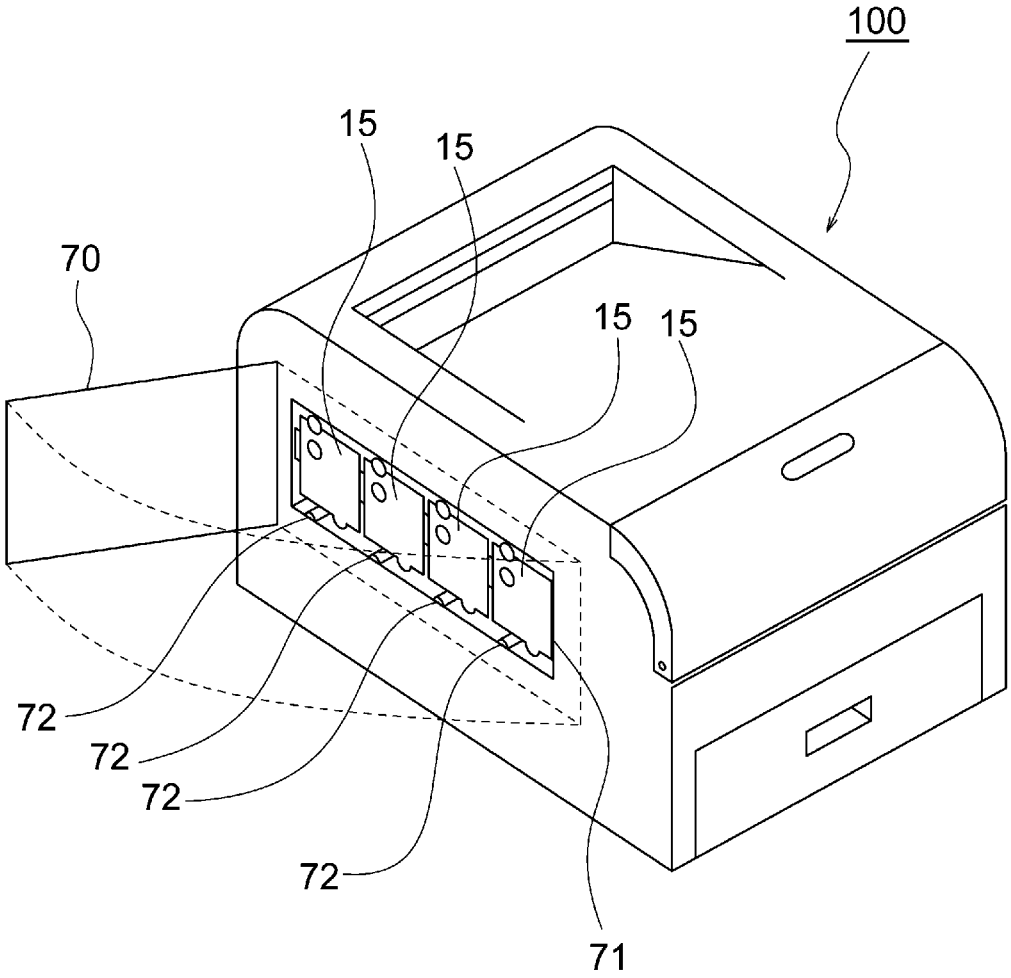
FIG. 5 is a schematic external perspective view of the image forming apparatus in the first embodiment, when the apparatus is ready for the replacement of the toner cartridges therein, or after the replacement of the toner cartridges in the apparatus.

FIG. 5 is an external perspective view of the image forming apparatus 100 during the installation of the toner cartridge 15 into the image forming apparatus 100.

Referring to FIG. 5, as an operator opens the front door 70 of the image forming apparatus 100, an opening 71 for installing the toner cartridge 15 appears. The main assembly 101 of the image forming apparatus 100 is provided with toner cartridge installation ribs 72. Thus, the toner cartridge 15 is to be slid (inserted) into the main assembly 101, with the installation ribs 72 being fitted in the installation guide 48 of the external shell 40.

Figure 6:
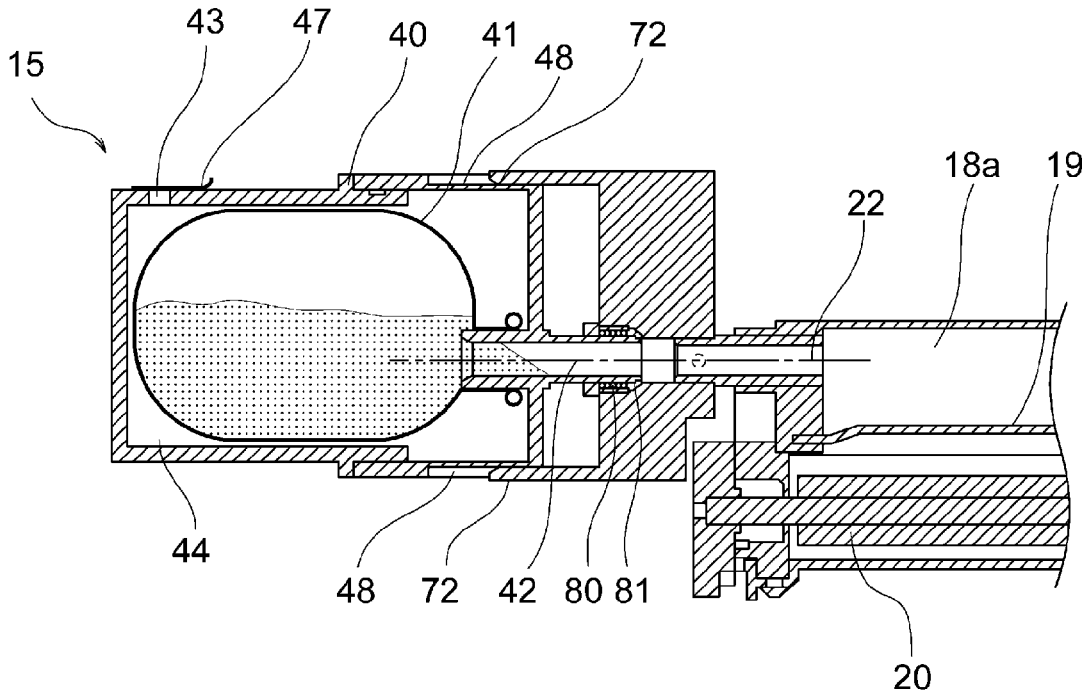
FIGS. 6(*a*) and 6(*b*) are schematic sectional views of the toner cartridge, and the portion of the image forming apparatus, with which the toner cartridge is coupled, in the first embodiment, after the installation of the cartridge into the apparatus, and is for showing the state of the toner cartridge in the apparatus.
Figure 6:
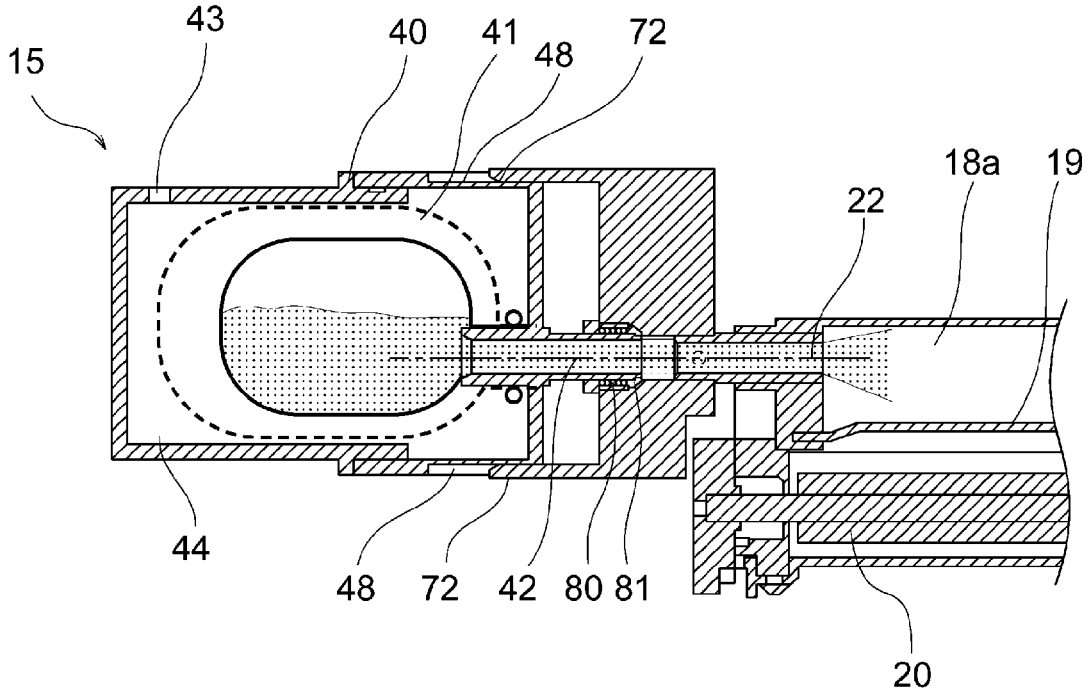

FIG. 6 is a schematic sectional view of the toner cartridge 15, and the portion of the image forming apparatus 100, with which the toner cartridge 15 is in connection. More specifically, FIG. 6(*a*) is a schematic sectional view of the toner cartridge 15, and the portion of the image forming apparatus 10, with which the toner cartridge 15 is in connection, right after the completion of the installation of the toner cartridge 15. FIG. 6(*b*) is practically the same as FIG. 16(*a*), except that in FIG. 6(*b*), the thin film seal 47 has just been peeled away.

The first step for installing the toner cartridge 15 into the image forming apparatus 100 is to peel the toner discharge passage seal 46. Then, the toner cartridge 15 is to be slid into the toner cartridge chamber of the apparatus main assembly 101. As the toner cartridge 15 is inserted, the toner discharge nozzle 42 enters the toner discharge nozzle receptacle 80 (developer discharge passage connector) of the image forming apparatus 100.

The toner discharge nozzle 42 is in the form of a piece of cylindrical tube, and its axial line is parallel to the direction in which the toner cartridge 15 is inserted into the apparatus main assembly 101. Further, the apparatus main assembly 101 is structured so that as the toner cartridge 15 is slid into the apparatus main assembly 101, the toner discharge nozzle 42 becomes connected to the toner discharge nozzle receptacle 80 of the apparatus main assembly 101.

The toner discharge nozzle receptacle 80 is in connection to the toner entrance 22 of the toner storage chamber 18*a*, enabling the toner storage chamber 18*a* to be supplied with toner 140 from the toner cartridge 15. Further, the toner discharge nozzle receptacle 80 is provided with a seal 81, which engages with the toner discharge nozzle 42 (toner discharge passage is inserted into seal 81) to prevent the toner 140 from scattering while the toner storage chamber 18*a* is supplied with the toner 140.

In this embodiment, an oil seal was employed as the seal 81. However, the seal 81 may be made of felt or sponge so that it is compressible by a preset amount.

Next, referring to FIG. 6(*b*), after the installation of the toner cartridge 15 into the image forming apparatus 100, a user is to remove the thin film seal 47 which is blocking the air passage 43. Prior to the removal of the thin film seal 47 for the air passage 43, the air in the airtight chamber 44 of the toner cartridge 15 is negative in pressure relative to the ambient air. Thus, the toner storage pouch 41 remained expanded (inflated) by the negative air pressure of the airtight chamber 44.

Thus, the moment the thin film seal 47 is removed, the ambient air flows (is introduced) into the airtight chamber 44, cancelling the negative air pressure of the airtight chamber 44. As a result, the force which kept the toner storage pouch 41 expanded (inflated), in coordination with the negative air pressure in the airtight chamber 44, is lost. Thus, the toner storage pouch 41, which is an elastic component, is allowed to be contracted (deflated) by its own resiliency (allowed to deform by contracting).

That is, the phenomenon that as the air passage 43 is unblocked by the removal of the thin film seal 47, the airtight chamber 44 stops remaining negative in its internal air pressure, and therefore, the toner storage pouch 41, which is an elastic component, is allowed to contract, can be utilized to discharge the toner 140 in the toner storage pouch 41, along with the air in the toner storage pouch 41, through the toner discharge nozzle 42. As the toner 140 is discharged through the toner discharge nozzle 42, it passes through the toner discharge nozzle receptacle 80, and enters the toner storage chamber 18*a* through the toner entrance 22.

The above-described structure of the combination of the image forming apparatus 100 and toner cartridge 15 in this embodiment, and its operation and effects, can be summarized as follows. That is, the developer supply container (toner cartridge 15) is equipped with a negative pressure maintaining-cancelling means (thin film seal 47, negative pressure maintenance portion), which is capable of utilizing the resiliency of the developer storage pouch 41 (toner storage pouch 41) made of an elastic substance, to keep the airtight chamber 44 (interior of external shell 40) negative in internal air pressure relative to the air pressure of the outside of the external shell 40, or cancelling the negative pressure of the internal air of the airtight chamber 41.

Therefore, until the developer supply container is installed into the apparatus main assembly 101, or in the like situation, the airtight chamber 44 is kept negative in its internal pressure to prevent the developer storage pouch 41 from contracting, in order to prevent the developer in the developer storage pouch 41 from being discharged from the pouch 41.

On the other hand, when it is necessary to release the toner in the toner storage pouch 41 to supply the apparatus main assembly 101 with developer after the installation of the toner cartridge 15 into the apparatus main assembly 101 of the image forming apparatus 100, the airtight chamber 44 is relieved of the negative pressure, being thereby made equal in air pressure to the ambience. Thus, the developer in the developer storage pouch 41 is discharged into the toner storage chamber 18*a* of the apparatus main assembly 101 through the developer discharge passage (toner discharge nozzle 42) by the resiliency of the developer storage pouch 41.

As described above, the developer is discharged by the negative pressure maintaining-cancelling means, the operation for discharging the developer can be controlled while the developer discharge passage (developer discharge nozzle 42) is kept open. Therefore, it is possible to prevent the problem which a combination of an image forming apparatus and a developer supply cartridge (toner cartridge 15), which is in accordance with the prior art, suffers, more specifically, the problem that, because the operation to discharge the toner in the toner storage pouch is controlled by the opening and closing of the developer discharge passage (developer discharge nozzle 42), a part of the developer discharge passage is increased in developer (toner) flow resistance, and therefore, the developer discharge passage is sometimes clogged up by the developer.

Embodiment 2

Next, the image forming apparatus in another embodiment of the present invention is described.

The portions of the image forming apparatus in this embodiment, which are the same as, or similar to, the counterparts in the first embodiment are given the same referential codes as those given to the counterparts, and are not described, in order not to repeat the same description. This embodiment is different from the first embodiment only in that the toner cartridge 15*a* is different in structure from the toner cartridge 15 in the first embodiment.

(Structure of Toner Cartridge)

Figure 7:
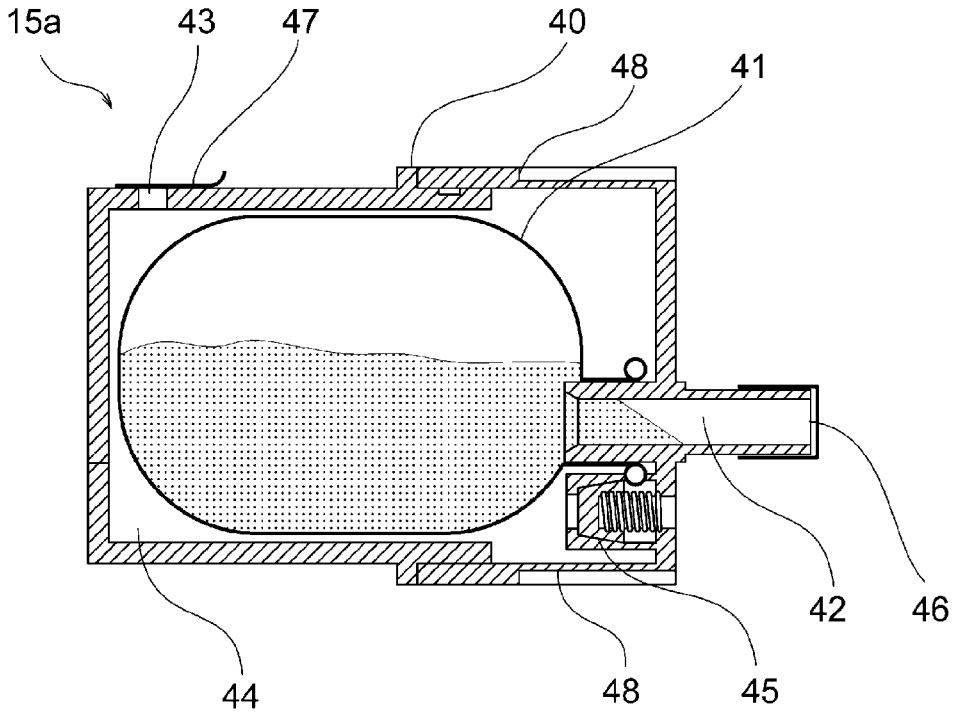
FIG. 7 is a schematic sectional view of the toner cartridge in the second embodiment of the present invention, and is for showing the structure of the toner cartridge.

FIG. 7 is a schematic sectional view of the toner cartridge 15*a* in this embodiment. It shows the structure of the toner cartridge 15*a*.

Referring to FIG. 7, the external shell 40 of the toner cartridge 15*a* is similar in structure as the toner cartridge 15 in the first embodiment, except that the external shell 40 of the toner cartridge 15*a* in this embodiment is provided with a one-way valve 45 for allowing the air in the airtight chamber 44 to be discharged out of the external shell 40. More specifically, the one-way valve 45 is between the airtight chamber 44 and the outside of the toner cartridge 15*a*. It allows the air in the airtight chamber 45 to flow out of the airtight chamber 44 into the ambience, but does not allow the ambient air to enter the airtight chamber 44. In other words, it is only in one direction, that is, from within the external shell 40 to the outside of the external shell 41, that the one-way valve 45 allows air to move through it.

More specifically, this embodiment is different from the first embodiment in the order in which the thin film seal 45 for preventing the ambient air from flowing into the airtight chamber 44 through the air passage 43, is attached to the external shell 40. Next, how the toner cartridge 15*a* is assembled is described.

(Filling of Toner Cartridge with Toner)

First, the process for filling the toner cartridge 15*a* with toner 140 is described. In the case of the toner cartridge 15*a* in this embodiment, it is after the attachment of the thin film seal 47 to the external shell 40 that the toner storage pouch 41 is filled with the toner 140.

When the toner storage pouch 41 for storing toner 140 is filled with toner 140, not only is it filled with a preset amount of toner 140 through the toner discharge nozzle 42, but also, the ambient air is forced into the toner storage pouch 40 through the toner discharge nozzle 42. Thus, as the toner 140 and air are filled into the storage pouch 41, the toner storage pouch 41 expands in the external shell 40, because the toner storage pouch 41 is elastic. Thus, the air in the airtight chamber 44 is compressed by the expansion of the toner storage pouch 41. However, the external shell 40 is provided with the one-way valve 45. Thus, a certain amount of the air in the airtight chamber 44 is discharged out of the external shell 40 (airtight chamber 44) through the one-way valve 45.

As described above, the toner cartridge 15*a* in this embodiment is provided with the one-way valve 45. Therefore, the toner storage pouch 41 in the external shell 40 of the toner cartridge 15*a* is allowed to expand even after the attachment of the thin film seal 47 to the external shell 40 to block the air passage 43.

By the way, the one-way valve 45 allows the air in the airtight chamber 44 to be discharged out of the external shell 40, but does not allow the ambient air of the external shell 40 to flow into the airtight chamber 44. That is, the air in the airtight chamber 44 is forced out of the external shell 40 by the expansion of the toner storage pouch 41. But, as long as the external shell 40 is kept airtight, the ambient air is not allowed to flow into the airtight chamber 44.

As the injection of air into the toner storage pouch 41 is stopped, the toner storage pouch 41 is made to contract by its resiliency attributable to its elasticity, like the toner storage pouch 41 in the first embodiment. However, the toner cartridge 15*a* in this embodiment is structured as described above. Therefore, it does not occur that as the toner storage pouch 41 contracts, the ambient air flows into the airtight chamber 44. Therefore, the air in the airtight chamber 44 is reduced in pressure. Thus, the airtight chamber 44 becomes, and remains, negative in air pressure relative to the atmospheric pressure (external pressure). Consequently, the force attributable to the contraction of the toner storage pouch 41 expanded by the air injected into the toner storage pouch 41 along with toner 140, becomes equal to the force generated by the negative pressure of the air in the airtight chamber 44. Thus, the toner storage pouch 41 remains expanded in the external shell 40.

Therefore, even after the toner storage pouch 41 becomes open to the atmospheric air through the toner discharge nozzle 42, it is possible to prevent the toner 140 in the toner storage pouch 41 from being discharged, along with the air in the toner storage pouch 41, from the toner storage pouch 41.

Prior to the shipment of the toner cartridge 15*a*, a toner discharge passage seal 46 is attached to the external shell 40 to block the toner discharge nozzle 42, in order to prevent the toner 140 and air in the toner storage pouch 41 from being discharged during the shipment of the toner cartridge 15*a*.

In the first embodiment, it is after the filling of the toner storage pouch 41 with a preset amount of a combination of toner 140 and air that the thin film seal 47 (negative pressure maintaining seal) is attached to the external shell 40 to block the air passage 43 to prevent the ambient air from flowing into the airtight chamber 44 through the air passage 43, or the air in the airtight chamber 44 from flowing out of the airtight chamber 44 through the air passage 43, in order to make, and keep, the air in the airtight chamber 44 negative in pressure.

In comparison, in this embodiment, the external shell 40 is provided with the one-way valve 45, which does not allow the ambient air to flow into the airtight chamber 44. Thus, as the toner storage pouch 41 is made to contract by its resiliency attributable to its elasticity after the discharging of the air in the airtight chamber 44 through the one-way valve 45, the airtight chamber 44 becomes negative in air pressure.

It takes a certain length of time for the adhesive used to attach the thin film seal 47 to the external shell 40 to block the air passage 43, to cure enough to prevent air from flowing into, or out of, the airtight chamber 44 through the air passage 43. Therefore, in the case of a toner cartridge structured like the one in the first embodiment, it was necessary for the toner cartridge to be left alone while the toner storage pouch 41 is kept high in internal pressure.

In the case of the toner cartridge 15*a* in this embodiment, the external shell 40 is provided with the one-way valve 45. Therefore, this embodiment is shorter than the first embodiment in the length of time it take to make the airtight chamber 44 negative in internal air pressure. In other words, providing a toner cartridge with the one-way valve 45 can improve the manufacturing of the toner cartridge in productivity.

The installation of the toner cartridge 15*a* in this embodiment into the image forming apparatus 100, and the discharging of toner 140 from the toner cartridge 15*a* into the toner storage chamber 18*a* to replenish with the toner storage chamber 18*a*, are the same as the installation of the toner cartridge 15 in the first embodiment into the image forming apparatus 100, and the discharging of toner 140 into the toner storage chamber 18*a* in the first embodiment.

Embodiment 3

Next, the image forming apparatus in another embodiment of the present invention is described.

The portions of the image forming apparatus in this embodiment, which are the same as, or similar to, the counterparts in the first embodiment are given the same referential codes as those given to the counterparts, and are not described in order not to repeat the same description. This embodiment is different from the first embodiment in that the toner cartridge 15*b* is different in structure from the toner cartridge 15 in the first embodiment.

(Structure of Toner Cartridge)

Figure 8:
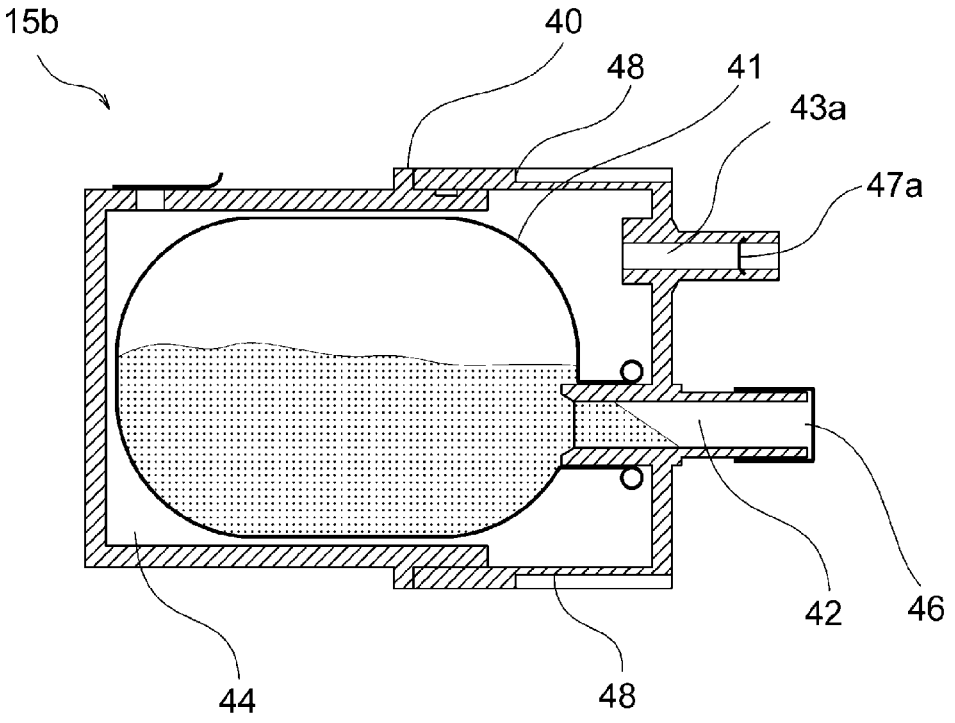
FIG. 8 is a schematic sectional view of the third embodiment of the present invention, and is for showing the structure of the toner cartridge.
Figure 9:
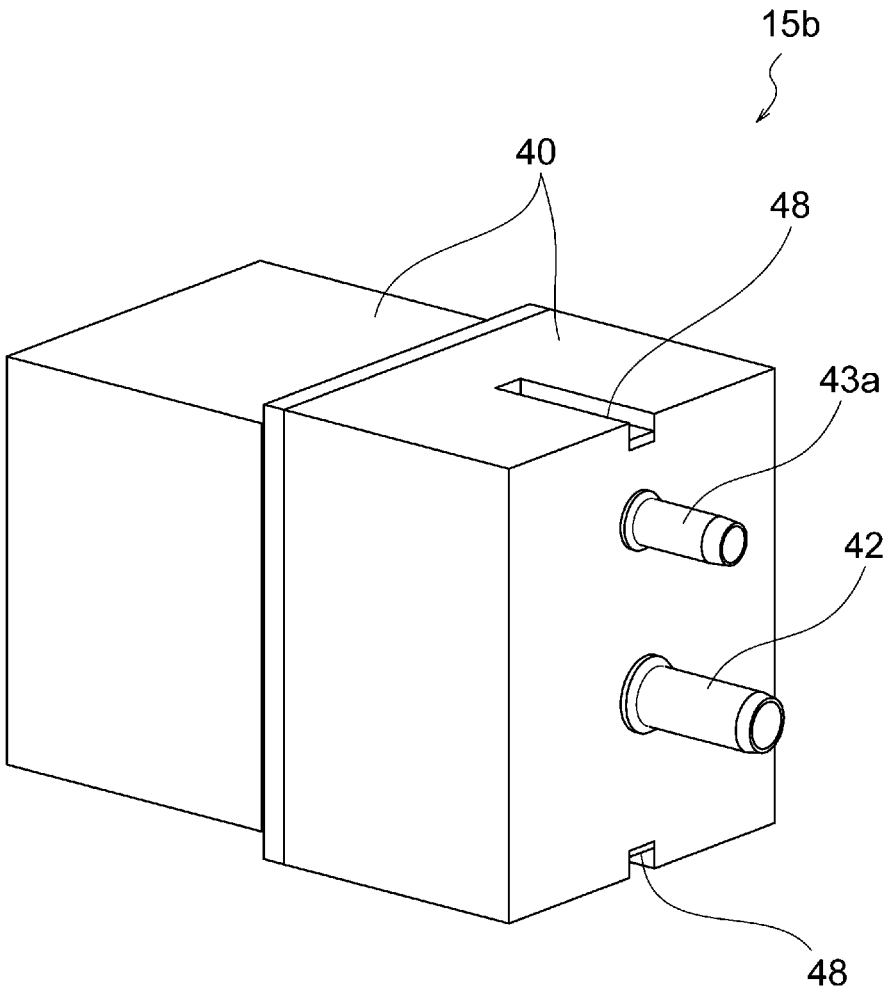
FIG. 9 is a schematic perspective view of the toner cartridge shown in FIG. 8, and is for showing the structure of the toner cartridge.

FIG. 8 is a schematic sectional view of the toner cartridge 15*b* in this embodiment. It shows the structure of the toner cartridge 15*b*. FIG. 9 is a schematic sectional view of the toner cartridge 15*b* in this embodiment. It shows the structure of the toner cartridge 15*b*.

Referring to FIGS. 8 and 9, the toner cartridge 15*b* in this embodiment is provided with an air suction nozzle 43*a*, which is on the same side as the toner discharge nozzle 42. The air suction nozzle 43*a* is the same in shape as the toner discharge nozzle 42. That is, it is in the shape of a cylindrical tube, and protrudes from the external shell 40, in the same direction as the direction in which the toner cartridge 15*b* is inserted into the apparatus main assembly 101.

(Installation of Toner Cartridge)

Figure 10:
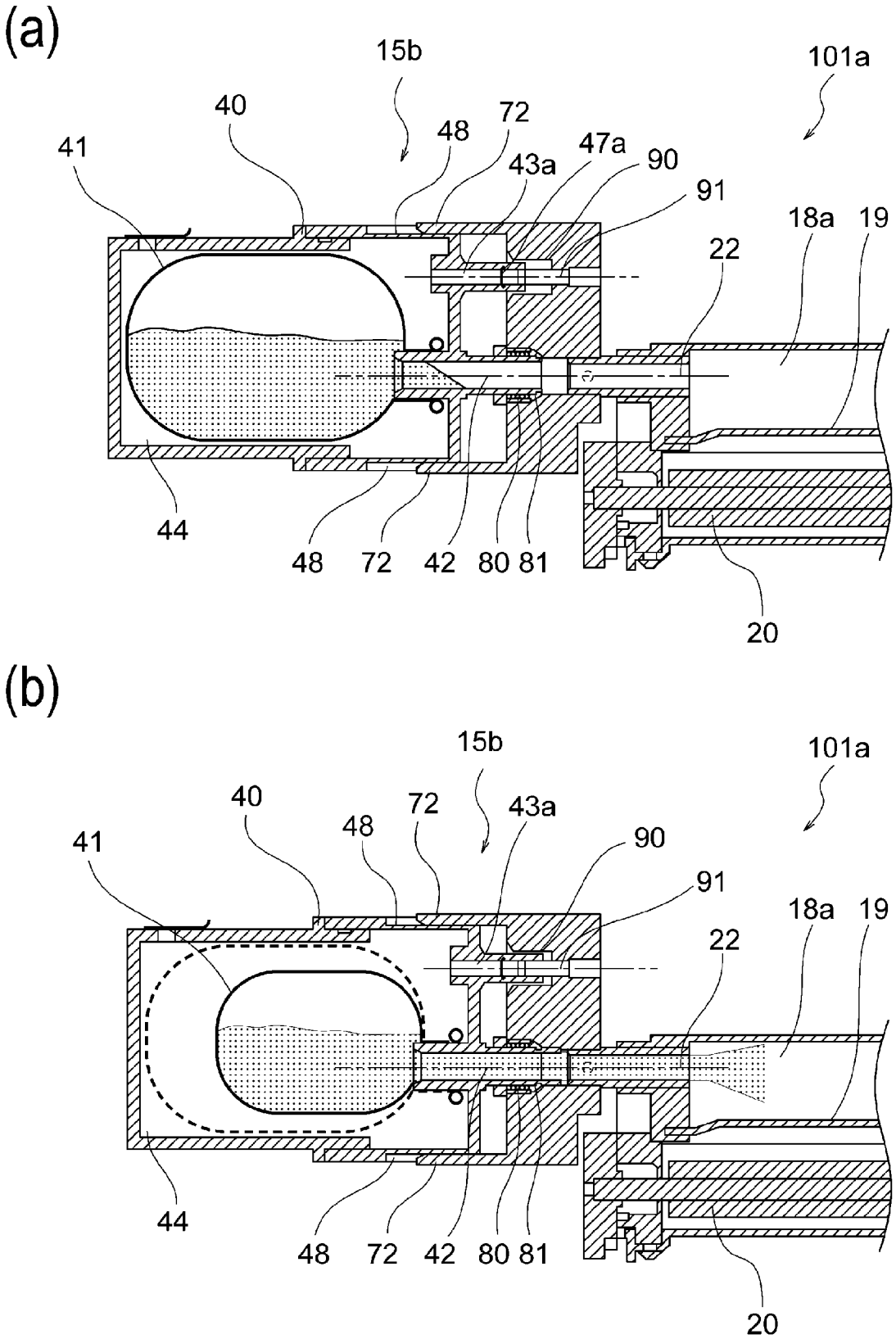
FIGS. 10(*a*) and 10(*b*) are schematic sectional views of the toner cartridge in FIG. 8, and the portion of the image forming apparatus, with which the toner cartridge is coupled, and is for showing the state of the toner cartridge and the portion of the image forming apparatus, with which the toner cartridge is coupled, after the proper installation of the cartridge into the image forming apparatus.

FIG. 10 is a schematic sectional view of the toner cartridge 15*b*, and the portion of the image forming apparatus 100*a*, with which the toner cartridge 15*b* is in connection. More specifically, FIG. 10(*a*) is a schematic sectional view of the toner cartridge 15*b*, and the portion of the image forming apparatus 10, with which the toner cartridge 15 is in connection, right after the insertion of the installation of the toner cartridge 15*b* halfway into the apparatus main assembly 101. FIG. 10(*b*) is practically the same as FIG. 10(*a*), except that in FIG. 10(*b*), the toner cartridge 15*b* is all the way in the image forming apparatus 100*a*.

The image forming apparatus 100*a* into which the toner cartridge 15*b* is slid is provided with an air suction nozzle receptacle 90, with which the air suction nozzle 43*a* is coupled.

As the toner cartridge 15*b* is slid into the image forming apparatus 100*a*, the toner discharge nozzle 42 begins to enter the toner discharge nozzle receptacle 80 of the image forming apparatus 100*a*, at a first point, shown in FIG. 10*a*), during the sliding of the toner cartridge 15*b* into the image forming apparatus 100*a*.

The toner discharge nozzle receptacle 80 is in connection to the toner entrance 22 with which the toner storage chamber 18*a* is provided as is the toner discharge nozzle receptacle 80 in the first embodiment. Thus, the toner 140 in the toner cartridge 15*b* can be supplied to the toner storage chamber 18*a*. Further, the toner discharge nozzle receptacle 80 is provided with a receptacle seal 81 which airtightly fits around the toner discharge nozzle 42 to prevent toner 140 from being scattered while the toner 140 is supplied into the toner storage chamber 18*a*. It is at the first position that the toner discharge nozzle 42 begins to fit into the receptacle seal 81.

Then, the toner cartridge 15*b* is inserted further into the apparatus main assembly 100*a* until it reaches the position (second position) shown in FIG. 10(*b*). During this movement of the toner cartridge 15*b*, the air suction nozzle 43 enters the air suction nozzle receptacle 90 with which the image forming apparatus 100*a* is provided.

The air suction nozzle 43*a* is in the form of a cylindrical tube. It axial line is parallel to the direction in which the toner cartridge 15*b* is inserted into the apparatus main assembly 101. Therefore, as the toner cartridge 15*b* is slid into the apparatus main assembly 101, the air suction nozzle 43*a* becomes connected to the air suction nozzle receptacle 90 of the apparatus main assembly 101.

The air suction nozzle receptacle 90 is provided with a seal breaking cylindrical member 91 for breaking the thin film seal 47*a* (negative pressure maintaining portion) with which the air suction nozzle 43*a* remains sealed. The central hollow of the seal breaking cylindrical member 91 is in connection to the internal space of the image forming apparatus 100*a*, the air pressure of which is the same as the atmospheric pressure.

As described before, the air suction nozzle 43*a* has been kept sealed by the thin film seal 47*a* in order to prevent the ambient air from entering into the airtight chamber 44, or the air in the airtight chamber 44 from being discharged from the airtight chamber 44. However, while the toner cartridge 15*b* is inserted to the second position from the first position, the thin film seal 47*a* for the air suction nozzle 43*a* comes into contact with the seal breaking member 91, and is broken by the seal breaking member 91.

Until the thin film seal 47*a* for the air suction nozzle 43*a* is broken, the airtight chamber 44 of the toner cartridge 15*b* remains negative in air pressure relative to the atmospheric pressure. That is, the toner storage pouch 41 is kept expanded by the negative air pressure of the airtight chamber 44.

However, the moment the thin film seal 47*a* is broken by the seal breaking member 91, the atmospheric air flows into the airtight chamber 44 through the cylindrical hollow of the seal breaking member 91 and the air suction nozzle 43*a*, making the internal air pressure of the airtight chamber 44 the same as the atmospheric pressure. Thus, the force generated by the negative internal air pressure of the airtight chamber 44 in the direction to keep the toner storage pouch 41 expanded is lost. Therefore, the toner storage pouch 41 is made to contract by its resiliency attributable to its elasticity.

Thus, the moment the airtight chamber 44 is made to lose its negative internal air pressure, it becomes possible to utilize the contraction of the toner storage pouch 41, which is an elastic member, to discharge the toner 140 in the toner storage pouch 41, along with the air in the toner storage pouch 41, through the toner discharge nozzle 42. As the toner 140 is discharged through the toner discharge nozzle 42, it travels through the toner discharge nozzle receptacle 80, and then, is supplied to the toner storage chamber 18*a* through the toner entrance 22.

In this embodiment, the toner cartridge 15*a* is structured so that the toner discharge nozzle 42 and air suction nozzle 43*a* protrude from the same side of the external shell 40. Thus, as the toner cartridge 15*b* is slid into the image forming apparatus 101*a*, the toner cartridge 15*b* is readied at the first position for discharging the toner 140 in the toner storage pouch 41, and then, the airtight chamber 44 is made to lose its negative internal air pressure at the second position to enable the toner cartridge 15*a* to discharge the toner 140.

That is, as the toner cartridge 15*b* is inserted into the image forming apparatus 100*a*, first, the toner passage is fully open, and then, the toner 140 begins to be discharged. Therefore, it does not occur that the toner 140 begins to be discharged before the toner passage is fully opened as in the case of a conventional toner cartridge. In other words, the toner cartridge 15*b* in this embodiment is substantially smaller in the amount of developer (toner) flow resistance which toner encounter as it flows through the toner passage of the toner cartridge when the toner is discharged from the toner cartridge, than any toner cartridge in accordance with the prior art.

Further, in the case of the toner cartridge 15*b* in this embodiment, its airtight chamber 44 is made to lose its negative internal air pressure with a preset timing while it is slid into the image forming apparatus 100*a*. Thus, it is unlikely for the toner cartridge 15*b* to be erroneously installed. That is, in the case of the toner cartridge 15 in the first embodiment, it is structured so that a user has to peel away the thin film seal 47 to make the airtight chamber 44 to lose its negative pressure in order to allow the toner storage pouch 41 to contract. Thus, it has to be after the insertion of the toner cartridge 15 into the image forming apparatus 100 that the thin film seal 47 is to be peed away.

In comparison, the toner cartridge 15*a* and image forming apparatus 100*a* in this embodiment are structured so that the thin film seal 47*a* (negative pressure maintaining means (portion)) is automatically broken with a preset timing during the insertion of the toner cartridge 15*a* into the image forming apparatus 100*a*. Thus, this embodiment can prevent the erroneous toner cartridge installation attributable to a user.

Concretely, in this embodiment, the toner discharge nozzle 42 and air suction nozzle 43*a* are 6 mm and 4 mm in internal diameter. In consideration of the developer (toner) flow resistance which the toner encounter as it is discharged from the toner cartridge 15*b*, the toner discharge nozzle 42 is desired to be no less than 4 mm in internal diameter. In comparison, the air suction nozzle 43*a* is for air to flow into, or out of, the airtight chamber 44. Therefore, the developer (toner) flow resistance of the air suction nozzle 43*a* has little effect upon the performance of the toner cartridge 15*b*. Therefore, the air suction nozzle 43*a* may be made smaller in internal diameter than the toner discharge nozzle 42. However, it is desired to be no less than 2 mm in internal diameter.

Further, making the air suction nozzle 43*a* smaller in diameter than the toner discharge nozzle 42 can makes it possible to reduce the toner cartridge 15*b* and image forming apparatus 100*a* in size, and also, to prevent the installation error.

Further, in this embodiment, the discharging of the toner 140 from the toner storage pouch 41 is controlled by a portion other than the toner discharge nozzle 42, through which the toner 140 flows when the toner 140 is discharged from the toner storage pouch 41. Therefore, the toner cartridge 15*b* in this embodiment is smaller in the developer (toner) flow resistance which the toner 140 encounters as it is discharged from the toner storage pouch 41, than the toner cartridge 15 in the first embodiment. That is, it can prevent the problem that when the toner 140 is discharged, the portion of the toner passage, which has not been fully opened, increases in developer (toner) flow resistance, and therefore, the toner flow is partially dammed up (blocked) by the partially open portion of the toner passage, causing a certain amount of toner 140 to agglomerate into larger particles or the like.

Further, it is after the toner passage becomes fully opened that the toner 140 is discharged. In addition, the discharging of the toner 140 is triggered by the beginning of the air flow (which is less affected by developer (toner) flow resistance of air passage) into the airtight chamber 44. Therefore, the pressure can be effectively released from the toner storage pouch 41 even though the image forming apparatus 100*a* is structured so that only temporary force, that is, the resiliency of elastic substance, is utilized to discharge the toner 140. Therefore, the toner cartridge 15*b* in this embodiment is less variable in the amount by which the toner 140 fails to be discharged from the toner storage pouch 41.

Embodiment 4

Next, the image forming apparatus in another embodiment of the present invention is described.

The portions of the image forming apparatus in this embodiment, which are the same as, or similar to, the counterparts in the first embodiment are given the same referential codes as those given to the counterparts, and are not described in order not to repeat the same description.

(Structure of Toner Cartridge)

Figure 11:
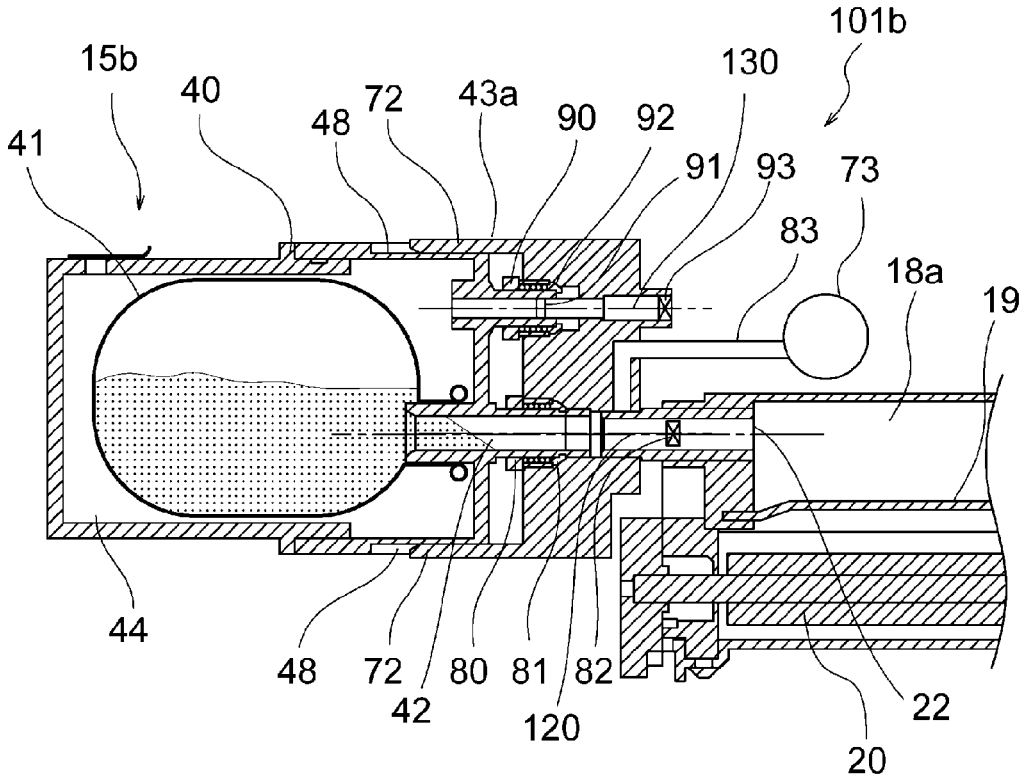
FIGS. 11(*a*) and 11(*b*) are drawings for showing the mechanism for re-inflating the toner storage pouch of the toner cartridge in the image forming apparatus, and the operational modes in which the image forming apparatus is operated to re-inflate the toner storage pouch.

FIG. 11 is a drawing which shows the structure and operational modes of the image forming apparatus in this embodiment. More specifically, FIG. 11(*a*) is a schematic sectional view of the toner cartridge, and the portion of the image forming apparatus, with which the toner cartridge is coupled, and FIG. 11(*b*) shows the operational modes of the image forming apparatus.

The image forming apparatus in this embodiment, shown in FIG. 11(*a*), is similar in basic structure to that in the third embodiment. It is different from the image forming apparatus in the third embodiment only in the following features.

That is, the image forming apparatus 100*b* in this embodiment is a toner discharge passage valve 82 (first opening-closing mechanism), which is in the middle of the toner entry passage 120 (developer entry passage), which is between the toner entrance 22 of the toner storage chamber 18*a*, and the toner discharge nozzle receptacle 80. Thus, the movement of airflow into, or out of, the toner storage pouch 41 through the toner discharge nozzle 42 can be controlled by the toner discharge passage vale 82. Further, an air injection passage 83 is provided between the toner discharge nozzle receptacle 80 and toner discharge passage valve 82. Further, the image forming apparatus 100*b* is provided with an air pump 73. Therefore, it is possible to inject air into the toner storage pouch 41 through the air injection passage 83 and toner discharge nozzle 42, with the use of the pump 73.

Further, the image forming apparatus 100*b* is provided with an air suction nozzle receptacle 90 which couples with the air suction nozzle 43*a* of the toner cartridge 15*b* when the toner cartridge 15*b* is inserted into the image forming apparatus 100*a*. The air suction nozzle receptacle 90 is provided with an air seal 92 for keeping airtight the joint between the air suction nozzle receptacle 90 and air suction nozzle 43*a*. Further, the air passage 130 which connects the air suction nozzle receptacle 90 and the apparatus main assembly 101*b* is provided with an air passage valve 93 (second mechanism for opening or closing air passage), which is for controlling the air movement into, or out of, the airtight chamber 44 (external shell 40).

The air suction nozzle receptacle 90 is provided with a seal breaking cylindrical member 91, like the seal breaking cylindrical member 91 in the third embodiment, which is for breaking the thin film seal 47*a* for the air suction nozzle 43*a*. In the third embodiment, the hollow of the seal breaking member 91 is directly in connection to the atmospheric air in the apparatus main assembly 101*a*. This embodiment is different from the third embodiment in that the air passage valve 91 in this embodiment is in connection to the atmospheric air through the air passage valve 93.

(Operation for Re-Expanding (Inflating) Toner Storage Pouch)

The toner storage pouch 41 is elastic. Thus, as air is injected into the toner storage pouch 41, it expands (elastically deform). When the toner cartridge 15*b* is shipped out of its manufacturing facility, the toner storage pouch 41 contains a preset amount of toner 140 and air, and therefore, remains expanded (inflated) in the external shell 40. It is possible, however, that as a substantially length of time elapses between when the toner cartridge 15*a* was shipped out and when it is used for the first time, the air in the toner storage pouch 41 will escape from the toner storage pouch 41. The following is the description of the operation to be carried out to re-expand (re-inflate) the toner storage pouch 41 in a case where the air in the toner storage pouch 41 will have escaped.

The toner discharge passage valve 82 and air passage valve 93 can be opened or closed, and are controlled in the modes shown in FIG. 11(*b*).

The first mode is the initial mode in which both the toner discharge passage valve 82 and air passage valve 93 are kept closed. In the next mode, or the second mode, the toner discharge passage valve 82 is kept closed, whereas air passage valve 93 is kept opened. Further, the pump 73 is activated to being to inject (send) air into the toner entry passage 120. As air is injected into the toner entry passage 120 by the pump 73, it is sent into the toner storage pouch 41 through the toner discharge nozzle 42, because the toner discharge passage valve 82 is closed.

As air is injected into the toner storage pouch 41, the toner storage pouch 41 begins to expand (inflate) in the external shell 40. The air passage valve 93 is open. Therefore, the air in the airtight chamber 44 is discharged out of the external shell 40 through the air suction nozzle 43*a*, by the expansion of the toner storage pouch 41.

Also in the second mode, as air is sent into the toner storage pouch 41, the toner 140 in the toner storage pouch 41 is loosened by the air flow, being made to higher in fluidity.

After the injection of a preset amount of air into the toner storage pouch 41 in the second mode, the operation is switched to the third mode, in which the toner discharge passage valve 82 is kept closed, and the air passage valve 93, which was kept open in the second mode, is opened. That is, the airflow into, or out of, the toner storage pouch 41 through the air suction nozzle 43*a* is blocked in order not to allow ambient air to flow into, or out of, the airtight chamber 44 (internal space of external shell 40) from outside the external shell 40. After the operation is switched to the third mode, the driving of the pump 73 is stopped to stop injecting air into the toner storage pouch 41.

Next, in the fourth mode, the air passage valve 93 is kept closed, and the toner discharge passage valve 82, which was kept closed in the second mode, is opened. Thus, the toner storage pouch 41 begins to be made to contract by its resiliency attributable to its elasticity. However, the air passage valve 93 is closed, and therefore, the atmospheric air is not allowed to flow into the airtight chamber 44. Thus, as the toner storage pouch 41 begins to contract, the airtight chamber 44 is reduced in its internal air pressure. Consequently, the internal air pressure of the airtight chamber 44 becomes lower than the atmospheric pressure; it becomes negative relative to the atmospheric pressure.

Thus, the toner storage pouch 41 can remain expanded in the external shell 40, in such a state that the force generated by the resiliency of the expanded toner storage pouch 41 in the direction to contract the toner storage pouch 41, is equal to the negative internal air pressure of the airtight chamber 41.

Therefore, even when the internal space of the toner storage pouch 41 is in connection to the atmospheric air through the toner discharge nozzle 42 which is in connection to the toner storage pouch 41, it is possible to prevent the toner 140 and air in the toner storage pouch 41 from being discharged from the toner storage pouch 41. As described above, in the fourth embodiment, the toner discharge passage valve 82 is fully opened to prepare for the discharging of the toner 140 from the toner storage pouch 41.

Lastly, in the fifth mode, the toner discharge passage valve 82 is kept open, and the air passage valve 93, which was kept closed in the third mode, is opened. Thus, the atmospheric air flows into the airtight chamber 44 through the air suction nozzle 43*a*, making the airtight chamber 41 not negative in internal pressure. Consequently, the force generated by the negative air pressure in the internal space of the airtight chamber 44 in the direction to keep the toner storage pouch 41 expanded is lost. Thus, the toner storage pouch 41 is made to contract by its resiliency attributable to its elasticity (deforms in a manner to reduce in size).

That is, the toner 140 in the toner storage pouch 41 can be discharged along with the air in the toner storage pouch 41, through the toner discharge nozzle 42 by the unitization of the phenomenon that the moment the airtight chamber 44 is made to begin losing its negative internal air pressure, the toner storage pouch 41 begins to contract.

After the discharging of the toner 140 in the toner storage pouch 41, the operation is switched to the initial mode, or the first mode, to prepare the toner cartridge 15*b* for the next toner discharging operation.

As described above, in this embodiment, the apparatus main assembly 101 is provided with a mechanism for re-injecting air into the toner storage pouch 41. Thus, even the air injected into the toner storage pouch 41 happens to escape from the toner storage pouch 41, it is possible to discharge the toner 140 from the toner cartridge 15*b*.

Incidentally, in this embodiment of the present invention, the toner passage through which the toner 140 is discharged from the toner storage pouch 41 is provided with the toner discharge passage valve 82. However, the process of discharging toner 140 is started in the fifth mode after the toner discharge passage valve 82 is fully opened in the fourth mode. Thus, it does not occur that the toner 140 begins to be discharged before the toner passage becomes fully open, as in the case of the toner cartridge in accordance with the prior art. Therefore, the toner cartridge 15*b* in this embodiment is substantially smaller in the amount of the developer (toner) flow resistance of its toner passage. Thus, it can prevent the problem that the portion of the toner passage, which is not fully open, increases the toner passage in developer (toner)

flow resistance, partially dams up (blocks) the toner flow, and causes the toner particles to agglomerate into large particles or the like.

Embodiment 5

Next, the image forming apparatus in another embodiment of the present invention is described.

The portions of the image forming apparatus in this embodiment, which are the same as, or similar to, the counterparts in the first embodiment are given the same referential codes as those given to the counterparts, and are not described in order not to repeat the same description.

(Structure of Toner Cartridge)

Figure 12:
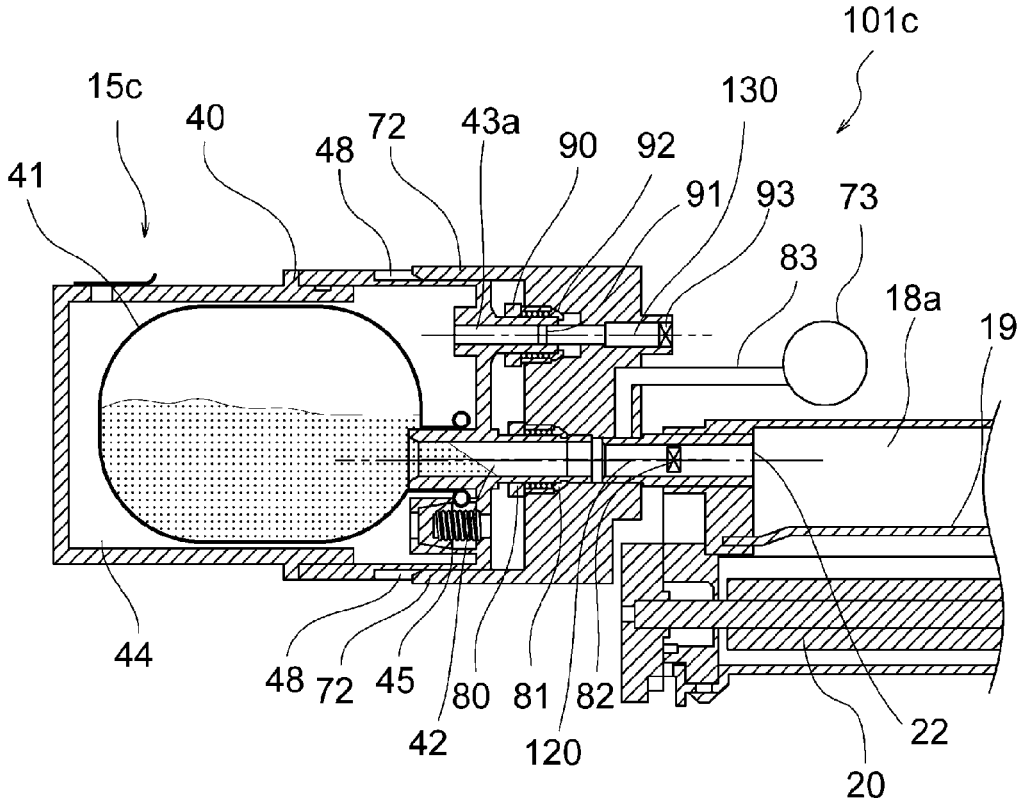
FIG. 12 is a drawing for showing another mechanism for re-inflating the toner storage pouch of the toner cartridge in the image forming apparatus, and the operational modes in which the image forming apparatus is operated to re-inflate the toner storage pouch.

FIG. 12 is a drawing which shows the structure and operational modes of the image forming apparatus in this embodiment. More specifically, FIG. 12(*a*) is a schematic sectional view of the toner cartridge, and the portion of the image forming apparatus, with which the toner cartridge is coupled, and FIG. 12(*b*) shows the operational modes of the image forming apparatus.

The image forming apparatus in this embodiment, shown in FIG. 12(*a*), is similar in basic structure to that in the fourth embodiment. It is different from the image forming apparatus in the fourth embodiment only in the following features.

The toner cartridge 15*c* in this embodiment has a one-way valve 45 for discharging the air in the airtight chamber 44 out of the external shell 40.

The toner cartridge 15*c* in this embodiment has the one-way valve 45. Therefore, it is different from the toner cartridge 15*b* in the fourth embodiment in the second and third modes in which air is re-injected into the toner storage pouch 41.

(Operation for Re-Expanding (Re-Inflating) Toner Storage Pouch)

Next, the operation to re-expanding (re-inflating) the toner storage pouch 41 in this embodiment is described.

Referring to FIG. 12(*b*), the apparatus main assembly 101*c* in this embodiment can be operated in one of the first to fifth modes in order to control the toner discharge passage valve 82 and air passage valve 93, and pump 73.

In the first mode, or the initial mode, both the toner discharge passage valve 82 and air passage valve 93 are kept closed.

Next, in the second mode, the pump 73 begins to be driven to inject air, with the toner discharge passage valve 82 and air passage valve 93 being kept closed. In the fourth embodiment, the toner discharge passage valve 82 is kept closed, and the air passage valve 93, which was kept closed in the first mode, is opened. In comparison, in this embodiment, in the second mode, both the toner discharge passage valve 82 and air passage valve 93 are kept closed.

Since the toner discharge passage valve 82 is kept closed, the air injected by the pump 73 is sent into the toner storage pouch 41 through the air injection passage 83 and toner discharge passage 41.

As air begins to be injected into the toner storage pouch 41, the toner storage pouch 41 begins to be inflated in the external shell 40, where by the air in the airtight chamber 44 begins to be compressed by the inflation of the toner storage pouch 41. However, the external shell 40 is provided with the one-way valve 45. Thus, as the air in the airtight chamber 44 begins to be compressed, it is allowed to be escape from the airtight chamber 44, into the outside of the external shell 40. In other words, in this embodiment, in the second mode, the air passage valve 93 is kept closed, the air in the airtight chamber 44 is discharged from the airtight chamber 44, out into the outside of the external shell 40, through the one-way valve 45.

In the second mode, as air is sent into the toner storage pouch 41, the toner 140 in the toner storage pouch 41 is loosened by the airflow, becoming therefore higher in fluidity, as in the case of the fourth embodiment.

After the injection of a preset amount of air into the toner storage pouch 41 in the second mode, the operation is switched to the third mode, in which both the toner discharge passage valve 82 and air passage valve 93 are kept closed as in the second mode, and then, the air injection into the toner storage pouch 41 is stopped by stopping the driving of the pump 73.

The one-way valve 45 allows the air in the airtight chamber 44 to be discharged out of the external shell 40, but, does not allow the ambient air of the external shell 40 to flow into the airtight chamber 44. That is, the air in the airtight chamber 44 is pushed out of the external shell 40 by the expansion of the toner storage pouch 41, but the atmospheric air is not allowed to flow into the airtight chamber 44 as long as it is ensured that the external shell 40 is kept airtight.

As the air injection into the toner storage pouch 41 is stopped as in the case of the fourth embodiment, the resiliency of the toner storage pouch 41 attributable to the elasticity of the toner storage pouch 41 begins to make the toner storage pouch 41 to contract. The image forming apparatus in this embodiment, however, is structured as described above. Therefore, even after the toner storage pouch 41 began to contract, no air flows into the airtight chamber 44. Thus, the air in the airtight chamber 44 is reduced in pressure. Therefore, the airtight chamber 44 becomes negative in internal air pressure relative to the atmospheric pressure. Consequently, the resiliency of the toner storage pouch 41, which works in the direction to make the toner storage pouch 41 to contract, balances with the negative internal air of the airtight chamber 44, allowing thereby the toner storage pouch 41 to remain inflated in the external shell 40.

Thus, even when the internal space of the toner storage pouch 41 is open to the atmospheric air through the toner discharge nozzle 42 which is in contraction to the internal space of the toner storage pouch 41, it is possible to prevent the toner 140 in the toner storage pouch 41 from being discharged along with the air in the toner storage pouch 41.

Next, in the fourth mode, the air passage valve 93 is kept closed and the toner discharge passage valve 82, which was kept closed in the third mode, is opened. As soon as the toner discharge passage valve 82 is opened, the toner storage pouch 41 begins to contract because of its resiliency attributable to its elasticity. However, the image forming apparatus in this embodiment is structured as described above. Thus, even after the toner storage pouch 41 begins to contract, the atmospheric air does not flow into the airtight chamber 44, because the air passage valve 93 is kept closed. Therefore, the air in the airtight chamber 44 is reduced in pressure, becoming negative in pressure relative to the atmospheric pressure (ambient air pressure).

Thus, the toner storage pouch 41 is allowed to remain inflated in the external shell 40, with the force which works in the direction to make the toner storage pouch 41 remain inflated by the air injected into the toner storage pouch 41, becoming equal to the negative pressure of the air in the airtight chamber 44.

Also in the fifth embodiment, the toner discharge passage valve 82 is kept opened, and the air passage valve 93, which was kept closed in the fourth mode, is also opened. Thus, the atmospheric air flows into the airtight chamber 44 through the air suction nozzle 43*a*, making thereby the airtight chamber 44 not negative in pressure. As a result, the force which was generated by the negative air pressure in the airtight chamber 44 and kept the toner storage pouch 41 inflated is lost, and therefore, the toner storage pouch 41 is made to contracts by its resiliency attributable to the elastic substance of which it is made of.

That is, the phenomenon that as soon as the airtight chamber 44 is made to lose its negative internal air pressure, the toner storage pouch 41, which is an elastic member, is made to contact by its resiliency, can be utilized to discharge the toner 140 in the toner storage pouch 41, along with the air in the air in the toner storage pouch 41, through the toner discharge nozzle 42.

After the discharging of the toner 140 in the toner storage pouch 41 in the fifth mode, the operation is switched to the first mode, in which the image forming apparatus is kept in the initial state, in order to prepare the image forming apparatus for the next toner discharge.

Embodiment 6

Next, the image forming apparatus in another embodiment of the present invention is described.

The portions of the image forming apparatus in this embodiment, which are the same as, or similar to, the counterparts in the first embodiment are given the same referential codes as those given to the counterparts, and are not described in order not to repeat the same description.

(Structure of Toner Cartridge)

Figure 13:
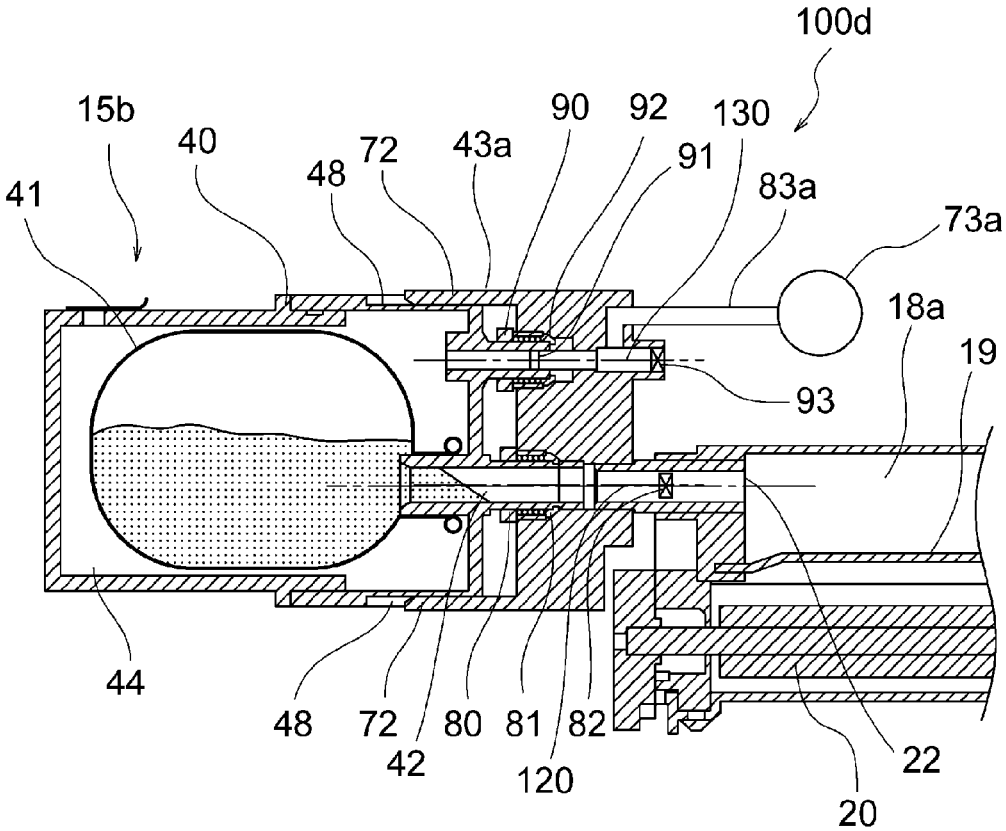
FIGS. 13(*a*) and 13(*b*) are drawings showing yet another mechanism for re-inflating the toner storage pouch of the toner cartridge in the image forming apparatus, and the operational modes in which the image forming apparatus is operated to re-inflate the toner storage pouch.

FIG. 13 is a drawing which shows the structure and operational modes of the image forming apparatus in this embodiment. More specifically, FIG. 13(*a*) is a schematic sectional view of the toner cartridge, and the portion of the image forming apparatus, with which the toner cartridge is coupled, and FIG. 13(*b*) shows the operational modes of the image forming apparatus.

Basically, the image forming apparatus in this embodiment, shown in FIG. 13(*a*), is similar in basic structure to that in the fourth embodiment. It is different from the image forming apparatus in the fourth embodiment only in the following features.

In this embodiment, an air suction passage 83*a* which is in connection to the pump 73*a* is between the air suction nozzle receptacle 90 and air passage valve 93. Thus, the atmospheric air can be suctioned into the airtight chamber 44 by the pump 73*a* through the air suction passage 83*a* and air suction nozzle 43*a*. The toner cartridge in this embodiment is the same as the toner cartridge 15*b* in the fourth embodiment.

(Operation to Re-Expand (Re-Inflate) Toner Storage Pouch)

Next, the operation to re-expand (re-inflate) the toner storage pouch 41 in this embodiment is described.

Referring to FIG. 13(*b*), the image forming apparatus 100*d* in this embodiment is provided with the first to fourth operational modes in which the toner discharge passage valve 82 and air passage valve 93, and pump 73*a* are controlled.

In the first mode, the image forming apparatus 100*d* are kept in the initial state, in which both the toner discharge passage valve 82 and air passage valve 93 are kept closed.

In the second mode, the air passage valve 93 is kept closed, whereas the toner discharge passage valve 82 is kept opened.

Also in the second mode, the pump 73*a* begins to be driven suction the air in the airtight chamber 44 out of the external shell 40, into the ambience through the air suction passage 83*a* and air suction nozzle 43*a*. Thus, the airtight chamber 44 is made to be negative in internal air pressure by the suctioning of the air in the airtight chamber 44 by the pump 73*a*.

As the airtight chamber 44 becomes negative in internal air pressure, the toner storage pouch 41 begins to inflate so that the force generated by the negative pressure of the internal air of the airtight chamber 44 becomes equal to the force generated by the elasticity of the toner storage pouch 41. In this mode, the toner discharge passage valve 82 is kept open. Therefore, the atmospheric air flows into the toner storage pouch 41 through the toner discharge nozzle 42, allowing thereby the toner storage pouch 41 to expand (inflate).

After a preset amount of air is suctioned out of the airtight chamber 44 in the second mode, the operation is switched to the third mode, in which the driving of the pump 73*a* is stopped to stop suctioning air out of the airtight chamber 44, while the air passage valve 93 is kept closed, and the toner discharge passage valve 82 is kept open.

Thus, the resiliency of the toner storage chamber 44 attributable to the elasticity of the toner storage pouch 41 begins to make the toner storage pouch 44 to contract. However, the air passage valve 93 of the image forming apparatus 100*d* in this embodiment structured as described above is kept closed. Thus, even the toner storage pouch 41 begins to contract, no air flows into the airtight chamber 44. Thus, the air in the airtight chamber 44 is reduced in pressure. Thus, the air in the airtight chamber 44 remains negative in pressure relative to the atmospheric pressure (ambient air pressure). As a result, the toner storage pouch 41 remains expanded (inflated) in the external shell 40, with the force which is generated by the resiliency of the inflated toner storage pouch 41, and works in the direction to make the inflated toner storage pouch 40 contracts, becoming equal to the negative air pressure in the toner storage pouch 41.

Therefore, even when the toner discharge passage valve 82 is kept open, and therefore, the internal space of the toner storage pouch 41 is open to the atmospheric air through the toner discharge nozzle 42 which is in connection to the internal space of the toner storage pouch 41, it is possible to prevent the toner 140 in the toner storage pouch 41 from being discharged, along with the air in the toner storage pouch 41. As described above, in the third mode, the toner discharge passage valve 82 is fully opened to prepare the image forming apparatus 100*d* and toner cartridge 15*c*, to discharge the toner 140 out of the toner storage pouch 41.

Lastly, in the fourth mode, the toner discharge passage valve 82 is kept open, and the air passage valve 93, which was kept closed in the third mode, is opened. Thus, the atmospheric air flows into the airtight chamber 44 through the air suction nozzle 43*a*, making thereby the air in the airtight chamber 44 loses its negative pressure. Therefore, the force which is attributable to the negative air pressure in the airtight chamber 44 and kept expanded (inflated) the toner storage pouch 41 is lost. Consequently, the resiliency of the toner storage pouch 41 which is an elastic member causes the toner storage pouch 41 to contract. In other words, it is possible to discharge the toner 140 in the toner storage pouch 41, along with the air in the toner storage pouch 41, by utilizing the phenomenon that the moment the air in the airtight chamber 44 loses its negative pressure, the toner storage pouch 41 contracts because of its resiliency.

After the discharging of the toner 140 in the toner storage pouch 41 by a present amount in the fourth mode, the operation is switched back to the first mode to prepare the image forming apparatus 100*d* for the next toner discharge.

Superiority of Present Invention to Prior Art

Next, the superiority of the present invention to the prior art is described. In the prior art, in order to control the operation to discharge the developer in a developer supply container with the utilization of the resiliency of the elastic member of the developer supply container, the developer passage through which the developer is discharged is provided with a valve.

That is, the developer in the developer supply container is prevented by the valve from being discharged from the container. However, the developer pouch is always under the pressure which is attributable to the resiliency of the elastic substance of which the developer pouch is made. This pressure continuously works in the direction to discharge the developer in the developer supply container out of the container. Therefore, as soon as the valve, which has been preventing the developer in the developer supply container from being discharged, begins to be opened, the pressure is released, and therefore, the developer in the developer supply container begins to be discharged.

This creates the following problem. That is, the developer begins to be discharged from the developer supply container before the valve is fully opened. Thus, the partially open portion of the valve increases the outward developer passage of the developer supply container in developer (toner) flow resistance. As the outward developer flow is impeded by the partially open portion of the valve, it is sometimes partially dammed up (blocked). Thus, some toner particles in the developer flow agglomerate into large particles of toner, which sometimes reduces an image forming apparatus in image quality.

Further, in the case of a toner cartridge in accordance with the prior art, which is structured to utilize temporary force, such as the force generated by the resiliency of the elastic substance of which the developer storage pouch of the toner cartridge is made, to discharge the developer from the developer storage pouch, it is possible the pressure for discharging the developer will be lost before the valve is fully opened. If the pressure for discharging the developer is lost before the valve is fully opened, the pressure difference for discharging the developer is sometimes lost before the developer is discharged from the developer container by a preset amount. Thus, the amount by which the developer in the developer supply container fails to be discharged is affected by the speed with which the valve is opened. That is, in some cases, the amount by which the developer in the developer supply container fails to be discharged became substantial.

In comparison, in the case of a toner cartridge in accordance with the present invention, in order to prevent the expanded (inflated) elastic toner storage pouch 41 from contracting (deflating), the air in the internal space (airtight chamber 44) of the external shell 40 is kept negative in air pressure. Further, when it is necessary to discharge the toner 140 in the toner storage pouch 41, the atmospheric air is allowed to flow into the airtight chamber 44 through the air suction nozzle 43*a* to make the air in the airtight chamber 44 lose its negative pressure.

That is, it is in the portion of the image forming apparatus and/or toner cartridge other than the toner discharge nozzle 42, which is the passage through which the toner 140 flows when it is discharged from the toner storage pouch 41, that the mechanism for controlling the discharging of the toner 140 in the toner storage pouch 41 is positioned. Therefore, the toner cartridge in accordance with the present invention is significantly smaller than any toner cartridge in accordance with the prior art, in the amount of the developer (toner) flow resistance which the toner 140 encounters in the toner passage while it is discharged from the toner storage pouch 41.

Further, in the preceding embodiments of the present invention, it does not occur that the toner 140 begins to be discharged before the toner passage is fully opened as in the case of a toner cartridge in accordance with the prior art. This alone can make the toner cartridges in the preceding embodiments significantly smaller in developer (toner) resistance than any toner cartridge in accordance with the prior art.

In addition, the preceding embodiments of the present invention can prevent the problem which the prior art suffers, more specifically, the problem that the portion of the toner passage, which is yet to be fully opened, temporarily increases the toner passage in developer (toner) flow resistance, which is likely to results in the formation of large particles of toner. Further, not only can the present invention ensure that it is only after the toner passage becomes fully open that the toner 140 can be discharged, but also, that the discharging of the toner 140 is triggered by the beginning of the airflow (which is less affected by the resistance of its passage than the developer (toner)) into the airtight chamber 44. Therefore, even thought the image forming apparatus and toner cartridge in accordance with the present invention are structured to utilize the temporary force, such as the force generated by the resiliency of the elastic substance of which the toner storage pouch 41 is made, to discharge the toner 140 in the toner storage pouch 41, they can effectively release the force attributable to the elastic substance. Thus, a toner cartridge in accordance with the present invention is unlikely to vary in the amount by which the toner 140 therein fails to be discharged.

Further, in the case of the prior art, the pressure for discharging the toner 140 and air in the toner storage pouch 41 is always present. Therefore, toner is likely to be scattered when the toner storage pouch 41 is refilled with air.

In comparison, in the case of the present invention, in order to keep expanded (inflated) the expanded (inflated) elastic toner storage pouch 41, the air in the airtight chamber 44 in the external shell 41 is made negative in air pressure. Therefore, the toner 140 is not discharged until the air in the airtight chamber 44 is made to lose its negative pressure. Therefore, even when the toner storage pouch 41 is refilled with air, the force for discharging the toner 140 can be kept under control. Therefore, the toner 140 can be prevented from scattering even when the toner storage pouch 41 is refilled with air.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 122650/2013 filed Jun. 11, 2013, which is hereby incorporated by reference.

What is claimed is:

1. A developer supply container for use with an image forming apparatus, comprising:

a shell having an air passage and a discharge nozzle;

a developer storage pouch storing developer, said developer storage pouch being contained inside said shell;

a discharging nozzle for discharging the developer accommodated in said developer storage pouch to outside of said developer supply container;

an air passage for allowing air to communicate between inside and outside of said shell; and a seal attached to said shell for sealing said air passage to maintain a pressure inside said shell in a negative pressure state which is lower than a pressure outside said shell, wherein said developer storage pouch is deformed to discharge the developer by said seal being peeled off said shell to permit air to enter said shell through said air passage.

2. An apparatus according to claim 1, wherein the developer and air are filled and sealed in said developer storage pouch.

3. An apparatus according to claim 1, wherein said developer storage pouch is elastic, and when the air enters said shell through said air passage, said developer storage pouch contracts by an elastic restoring force.

4. An apparatus according to claim 1, further comprising a one-way valve connecting the inside and the outside of said shell, said one-way valve permitting flow of the air from the inside to the outside of said shell while preventing flow of the air from the outside to the inside of said shell.

5. An apparatus according to claim 4, wherein the developer and the air are compressed in said developer storage pouch with said seal closing said air path passage.

6. An apparatus according to claim 1, wherein said shell includes a facing side which faces a mounting portion of a main assembly of an image forming apparatus when said developer supply container is mounted to the main assembly, wherein said discharging nozzle and said air passage are provided on the facing side.

7. An apparatus according to claim 6, wherein said discharging nozzle and said air passage are in the form of pipes projecting from the facing side.

8. An apparatus according to claim 1, wherein an inner diameter of said air passage is smaller than an inner diameter of said discharging nozzle.

9. An apparatus according to claim 1, wherein said discharging nozzle is provided with a sealing member for preventing the developer from leaking out of said developer storage pouch when said developer supply container is not mounted to a main assembly of the image forming apparatus.

10. An apparatus according to claim 1, wherein said air passage includes an opening provided through said container, and said seal includes a sealing member sealing said opening.

11. An image forming apparatus for forming an image on a recording material, said image forming apparatus comprising:

a developer supply container; and a main assembly to which said developer supply container is detachably mountable;

said developer supply container including, a shell having an air passage and a discharge nozzle, a developer storage pouch storing developer, said developer storage pouch being contained inside said shell, a developer discharging path a discharging nozzle for discharging the developer accommodated in said developer accommodation bag storage pouch to outside of said developer supply container, an air passage for allowing air to communicate between inside and outside of said shell, and a seal attached to said shell for sealing said air passage to maintain a pressure inside said shell in a negative pressure state which is lower than a pressure outside said shell;

said main assembly including, a discharging nozzle connecting portion connecting with said discharging nozzle to supply into said main assembly the developer discharged through said discharging nozzle of said developer supply container when said developer supply container is mounted to said main assembly, wherein said developer storage pouch is deformed to discharge the developer by said seal being peeled off said shell to permit air to enter said shell through said air passage.

12. An apparatus according to claim 11, said main assembly further comprising an air passage connecting portion connecting with said air passage to supply the air into said shell through said air path passage when said developer supply container is mounted to said main assembly.

13. An apparatus according to claim 12, wherein after said discharging nozzle and said discharging nozzle connecting portion are connected with each other to enable passage of the developer when said developer supply container is mounted to said main assembly, the air is supplied into said shell through said air nozzle, by which the inside negative pressure of said shell is released.

14. An apparatus according to claim 13, wherein when said developer supply container is slidable into said main assembly, said discharging nozzle is connected with said discharging nozzle connecting portion at a first position partway in an insertion sliding path, and said air passage is connected with said air passage connecting portion at the second position which is downstream of a first position with respect to an inserting direction, and wherein after passage of the developer is enabled at the first position, the air is supplied into said shell through said air passage at the second position.

15. An apparatus according to claim 14, wherein at the second position, said air passage connecting portion is contacted to said seal which is provided in said air passage to open said air passage.

16. An apparatus according to claim 12, further comprising a pump for supplying the air into said developer storage pouch from said discharging nozzle connecting portion when said developer supply container is mounted to said main assembly.

17. An apparatus according to claim 16, said main assembly further including a first opening and closing mechanism for controlling inward and outward air flow through a developer introduction path by opening and closing the developer introduction path for introducing the developer discharged from said discharging nozzle into said main assembly, and a second opening and closing for controlling inward and outward air flow through said air passage by opening and closing a connection path connecting said air passage connecting portion and an inside of said main assembly, wherein in a state that said first opening and closing mechanism closes said developer introduction path and said second opening and closing mechanism opens said connection path, said image forming apparatus starts supply of the air into said developer storage pouch by said pump, and closes said connection path by said second opening and closing mechanism while maintaining the closing of the developer introduction path by said first opening and closing mechanism to stop delivery of the air by said pump, and after said first opening and closing mechanism opens said developer introduction path, said image forming apparatus enables supply of the developer from said developer storage pouch into said main assembly by opening said connection path by said second opening and closing mechanism.

18. An apparatus according to claim 12, further comprising a pump for sucking air from inside of said shell, said air passage connecting portion, and said air passage when said developer supply container is mounted to said main assembly.

19. An apparatus according to claim 18, said main assembly further including a first opening and closing mechanism for controlling inward and outward air flow through a developer introduction path by opening and closing said developer introduction path for introducing the developer discharged from said discharging nozzle into said main assembly, and a second opening and closing for controlling inward and outward air flow through said air passage by opening and closing a connection path connecting said air passage connecting portion and an inside of said main assembly, wherein in a state that said first opening and closing mechanism opens said developer introduction path and said second opening and closing mechanism closes said connection path, said image forming apparatus starts suction of air from said developer storage pouch by said pump, and opens said connection path by said second opening and closing mechanism while maintaining the opening of said developer introduction path by said first opening and closing mechanism to enable supply of the developer into said main assembly from said storage pouch.

20. An apparatus according to claim 12, wherein said developer supply container further includes a one-way valve connecting the inside and the outside of said shell, said one-way valve permitting flow of the air from the inside to the outside of said shell while preventing flow of the air from the outside to the inside of said shell, wherein said main assembly further includes a pump for supplying the air into said developer storage pouch and a developer discharging path from said discharging nozzle connecting portion when said developer supply container is mounted to said main assembly, a first opening and closing mechanism for controlling inward and outward air flow through a developer introduction path by opening and closing the developer introduction path for introducing the developer discharged from said developer discharging path into said main assembly, and a second opening and closing for controlling inward and outward air flow through said air passage by opening and closing a connection path connecting said air fluid communication path connecting portion and an inside of said main assembly, wherein in a state that said first opening and closing mechanism closes said developer introduction path and said second opening and closing mechanism closes said connection path, said image forming apparatus executes supply of the air, and after said first opening and closing mechanism opens said developer introduction path, said image forming apparatus enables supply of the developer from said developer storage pouch into said main assembly by opening said connection path by said second opening and closing mechanism.

* * * * *